US009925552B2

(12) United States Patent
Saine

(10) Patent No.: US 9,925,552 B2
(45) Date of Patent: Mar. 27, 2018

(54) LIQUID DISPENSING APPLICATORS HAVING BACKPRESSURE CONTROL DEVICES, AND RELATED METHODS

(71) Applicant: Nordson Corporation, Westlake, OH (US)

(72) Inventor: Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 83 days.

(21) Appl. No.: 14/641,947

(22) Filed: Mar. 9, 2015

(65) Prior Publication Data

US 2016/0263608 A1 Sep. 15, 2016

(51) Int. Cl.

| | |
|---|---|
| ***B05B 17/00*** | (2006.01) |
| ***B05B 15/04*** | (2006.01) |
| ***B05C 5/02*** | (2006.01) |
| ***B05B 7/04*** | (2006.01) |
| ***B05B 9/01*** | (2006.01) |

(52) U.S. Cl.

CPC ..... *B05B 15/0406* (2013.01); *B05B 7/0416* (2013.01); *B05B 9/01* (2013.01); *B05C 5/0237* (2013.01); *B05C 5/0279* (2013.01)

(58) Field of Classification Search

CPC ..... B05B 15/0406; B05B 7/0416; B05B 9/01; B05C 5/0237; B05C 5/0279

USPC ..... 239/290, 296, 548, 566, 124, 127, 1

See application file for complete search history.

(56) References Cited

U.S. PATENT DOCUMENTS

| | | | | |
|---|---|---|---|---|
| 5,636,790 | A * | 6/1997 | Brusko | B05B 7/0861 239/127 |
| 6,089,413 | A | 7/2000 | Riney et al. | |
| 6,422,428 | B1 | 7/2002 | Allen et al. | |

(Continued)

FOREIGN PATENT DOCUMENTS

| | | |
|---|---|---|
| EP | 1442798 | 8/2004 |
| EP | 1946846 | 7/2008 |
| KR | 200441757 | 9/2008 |

OTHER PUBLICATIONS

European Application No. 16155247.6: European Extended Search Report dated Oct. 27, 2016, 11 pages.

(Continued)

*Primary Examiner* — Steven J Ganey

(74) *Attorney, Agent, or Firm* — Baker & Hostetler LLP

(57) ABSTRACT

An applicator for dispensing liquid material onto a substrate includes a body, a valve module body having a valve stem, and a backpressure control device provided in the and having a device passage. The body includes an inlet passage, a dispensing outlet passage, and a recirculation outlet passage. The valve module has a dispensing mode and a recirculation mode, and directs the liquid material through the dispensing outlet passage in the dispensing mode and directs the liquid material through the recirculation outlet passage in the recirculation mode. The valve stem is movable between an open position in the dispensing mode and a closed position in the recirculation mode. The backpressure control device directs the liquid material through the device passage in the recirculation mode such that a backpressure of the liquid material in the recirculation mode is substantially equal to a backpressure of the liquid material in the dispensing mode.

20 Claims, 13 Drawing Sheets

(56) References Cited

U.S. PATENT DOCUMENTS

| | | | | |
|---|---|---|---|---|
| 6,607,104 | B2 * | 8/2003 | McGuffey | B05C 5/0225 222/318 |
| 7,611,071 | B2 | 11/2009 | Bolyard, Jr. et al. | |
| 7,878,375 | B2 * | 2/2011 | Yajima | B05C 11/1039 239/124 |
| 2005/0242108 | A1 | 11/2005 | Harris et al. | |
| 2007/0246576 | A1 | 10/2007 | Bolyard et al. | |

OTHER PUBLICATIONS

European Application No. 16155247.6: Partial European Search Report dated Jul. 21, 2016, 7 pages.

* cited by examiner

LIQUID DISPENSING APPLICATORS HAVING BACKPRESSURE CONTROL DEVICES, AND RELATED METHODS

TECHNICAL FIELD

The present invention relates generally to liquid dispensing applicators for dispensing liquid material onto a substrate, and more particularly, to liquid dispensing applicators having valve modules that recirculate undispensed liquid material.

BACKGROUND

Thermoplastic materials, such as hot melt adhesive, are dispensed and used in a variety of applications including the manufacture of diapers, sanitary napkins, surgical drapes, and various other nonwoven products. This technology has evolved from the application of linear beads or fibers of material and other spray patterns, to air-assisted applications, such as spiral and melt-blown depositions of fibrous material.

Known adhesive applicators used for dispensing such thermoplastic materials may include one or more valve modules for applying the intended deposition pattern of adhesive, each valve module having valve components that operate in an on/off fashion. One example of a valve module is disclosed in U.S. Pat. No. 6,089,413, assigned to the assignee of the present invention, and the disclosure of which is hereby fully incorporated by reference herein in its entirety. This module includes valve structure which switches the module between ON and OFF conditions relative to the dispensed material.

In the ON condition, the module is in a dispensing mode in which pressurized liquid material fed into the module through a liquid inlet passage is directed through a dispensing outlet passage and into a dispensing nozzle for deposition onto the substrate. In the OFF condition, the module switches into a recirculating mode in which the pressurized liquid material fed into the module is redirected to a recirculation outlet passage and into a recirculation channel in a manifold of the applicator. The liquid material is transferred through the recirculation channel of the manifold and then through a recirculation conduit leading back toward an adhesive supply reservoir located remotely from the applicator. Recirculating undispensed liquid material during the OFF condition advantageously prevents excessive pressure buildup within the module, which would otherwise distort the shape of the next pattern of liquid material dispensed when the module returns to the ON condition.

During the ON condition, the liquid material flowing through the module is exposed to a first pressure, referred to herein as a "dispensing pressure" (also known as an "application pressure"), as it is forced through the dispensing outlet passage and the dispensing nozzle. The dispensing pressure is a combined result of a flow rate pressure and a dispensing backpressure. The flow rate pressure is a function of forces exerted on the supply material by a liquid pump operating at a given liquid flow rate. The dispensing backpressure is a function of forces exerted on the liquid material by the inner surfaces of the passages and chambers through which the liquid material is forced during dispense, including the dispensing outlet passage and the internal passages of the dispensing nozzle.

During the OFF condition, the liquid material flowing through the module is exposed to a second pressure, referred to as a "recirculation pressure," as it is redirected through the recirculation outlet passage and into the recirculation channel of the manifold. The recirculation pressure is a combined result of the flow rate pressure and a recirculation backpressure. As described above, the flow rate pressure is a function of the liquid flow rate at which the liquid pump is operating. The recirculation backpressure is a function of forces exerted on the liquid material by the inner surfaces of the passages and chambers through which the liquid material is forced during recirculation, including the recirculation outlet passage and the recirculation channel.

In known valve modules, the dispensing backpressure experienced by the liquid material during the ON condition is generally greater than the recirculation backpressure experienced during the OFF condition. Due to the amount time required for the module to shift its valve components between the OFF (recirculating) and ON (dispensing) conditions, the differential between the dispensing pressure and recirculation pressure acts to hinder the ability of the module to dispense with accurate volumetric outputs at the start of a dispense cycle in the ON condition.

Known dispensing systems include an applicator having a manifold fitted with one or more valve modules along a length of the applicator. On example of such an applicator is disclosed in U.S. Pat. No. 6,422,428, assigned to the assignee of the present invention, and the disclosure of which is hereby fully incorporated by reference herein in its entirety. Such dispensing systems allow the flexibility for one or more of the valve modules on the applicator to be operated at a unique liquid flow rate and/or to be fitted with a dispensing nozzle that yields a unique dispensing backpressure during use. Accordingly, one or more of the modules on the applicator may operate with a unique pressure differential caused by a unique dispensing pressure and/or a unique recirculation pressure.

Known dispensing systems may also include a single backpressure control valve, positioned remotely from the applicator near the liquid supply reservoir, and operable to control a backpressure within the recirculation conduit with which each of the modules communicates. However, this single control valve is incapable of controlling a backpressure within each module individually, and thus is ineffective to neutralize unique pressure differentials across multiple modules on the applicator. As such, a significant pressure differential remains in one or more of the valve modules, which negatively affects dispensing performance for that module(s), as described above.

Accordingly, a need remains for improvement in liquid dispensing applicators to address the present challenges and shortcomings such as those described above.

SUMMARY

An exemplary applicator according to a first embodiment for dispensing liquid material onto a substrate includes a body, a valve module, and a backpressure control device. The body includes an inlet passage for receiving liquid material, a dispensing outlet passage for directing the liquid material toward the substrate, and a recirculation outlet passage for recirculating the liquid material. The valve module has a dispensing mode and a recirculation mode. The valve module directs the liquid material through the dispensing outlet passage in the dispensing mode and directs the liquid material through the recirculation outlet passage in the recirculation mode. The valve module includes a valve stem movable between an open position in which the valve module operates in the dispensing mode and a closed position in which the valve module operates in the recirculation mode. The backpressure control device is provided in the body and has a device passage that communicates with the recirculation outlet passage. The backpressure control device directs the liquid material through the device passage when the valve module is in the recirculation mode such that a backpressure experienced by the liquid material in the recirculation mode is substantially equal to a backpressure experienced by the liquid material in the dispensing mode.

An exemplary applicator according to a second embodiment for dispensing liquid material onto a substrate includes a first valve module having a first valve stem and a second valve module having a second valve stem. Each of the first and second valve modules has a dispensing mode for dispensing liquid material and a recirculation mode for recirculating liquid material. The applicator further includes a first backpressure control device that controls a backpressure of the liquid material recirculated by the first valve module, and a second backpressure control device that controls a backpressure of the liquid material recirculated by the second valve module.

An exemplary method according to a first embodiment for dispensing liquid material with an applicator is also provided. The applicator includes a body having an inlet passage, a valve module having a valve stem movable between an open position for dispensing liquid material and a closed position for recirculating liquid material, and a backpressure control device provided in the body and having a device passage and a device portion that is movable relative to the body. The method includes receiving liquid material through the inlet passage formed in the body, and directing the liquid material from the inlet passage toward the valve stem. The method further includes moving the valve stem to the closed position, and directing the liquid material through the device passage of the backpressure control device and through the recirculation outlet passage such that the liquid material experiences a predetermined amount of backpressure. The method further includes moving the device portion in a first direction to increase the backpressure and/or moving the device portion in a second direction to decrease the backpressure.

An exemplary method according to a second embodiment for dispensing liquid material with an applicator is also provided. The applicator includes a first valve module and a second valve module. The method includes receiving liquid material into the first valve module and the second valve module, and opening the first and second valve modules to dispense the liquid material. The method further includes closing the first and second valve modules to stop dispensing the liquid material, and recirculating the liquid material while the first and second valve modules are closed. The method further includes independently controlling a first recirculation backpressure in the first valve module relative to a second recirculation back pressure in the second valve module while recirculating the liquid material.

Various additional features and advantages of the invention will become more apparent to those of ordinary skill in the art upon review of the following detailed description of the illustrative embodiments taken in conjunction with the accompanying drawings.

DETAILED DESCRIPTION

Figure 1A:
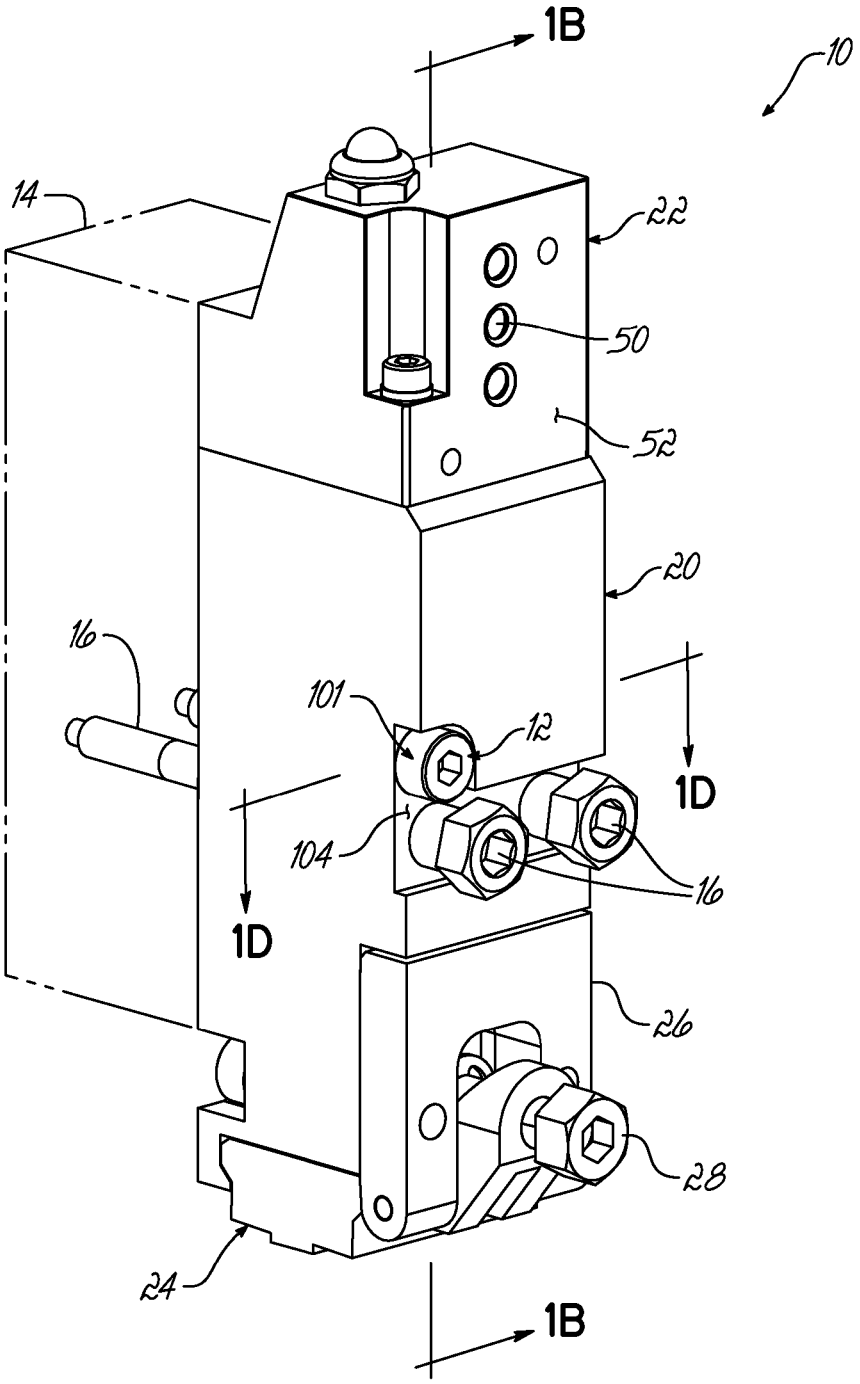
FIG. 1A is a front perspective view of a face-mount-style valve module coupled with an applicator manifold, shown schematically, and provided with an adjustable recirculation backpressure control device in accordance with a first embodiment of the invention.

Referring to FIGS. 1A-1D, a first embodiment of a liquid dispensing applicator having a valve module 10, provided with an adjustable recirculation backpressure control device 12, is shown. The valve module 10 is mountable to a manifold 14, shown schematically as a manifold segment, of a liquid dispensing applicator using mounting bolts 16. The valve module 10 is operable to dispense liquid material, such as hot melt adhesive, onto a substrate (not shown). The dispensing applicator may include multiple manifold segments 14 arranged in side-by-side relation, each manifold segment 14 having a corresponding valve module 10 operatively coupled to the manifold segment 14, as disclosed in U.S. Pat. No. 6,422,428, incorporated by reference above. In alternative embodiments, the manifold segment 14 shown herein may be an integral portion of a monolithic manifold formed as a single unitary piece of the dispensing applicator, as disclosed in U.S. Pat. No. 6,089,413, also incorporated by reference above. In that regard, it will be understood that the various features of the embodiments of the invention described herein may be adapted for liquid dispensing applicators having manifolds of various configurations.

The valve module 10 includes a module body 20, an air cap 22 operatively coupled to an upper portion of the module body 20, and a dispensing nozzle 24 releasably coupled to a lower portion of the module body 20 with a nozzle retaining clamp 26 having a clamp screw 28. As described in greater detail below, the module 10 is operable in a liquid dispensing mode in which liquid material is pumped by a liquid pump 2 to the module 10 from a liquid material supply reservoir 4 located remotely from the applicator, and is then dispensed from the dispensing nozzle 24. The module 10 is also operable in a liquid recirculation mode in which the liquid material pumped to the module 10 is not dispensed but rather recirculated back toward the liquid supply reservoir 4.

In one embodiment, an independent liquid pump 2 may be provided for use with each of the valve modules 10 of the applicator. For example, each independent liquid pump 2 may be coupled directly to the applicator manifold 14 at each valve module position along with length of the manifold 14. Alternatively, each liquid pump 2 may be provided remotely from the applicator and be coupled to the manifold 14 or to its respective valve module 10 via conduit. In another embodiment, the liquid pump 2 may be in the form of a single liquid pump that operates to deliver liquid material to all of the valve modules 10 on the applicator. For example, the single liquid pump 2 may be coupled directly to the applicator manifold 14. Alternatively, the single liquid pump 2 may be provided remotely from the applicator and be coupled to the manifold 14 or the valve modules 10 via conduit. It will be understand that these various configurations of the liquid pump 2 may be applied to the additional embodiments of the invention described below.

Figure 1B:
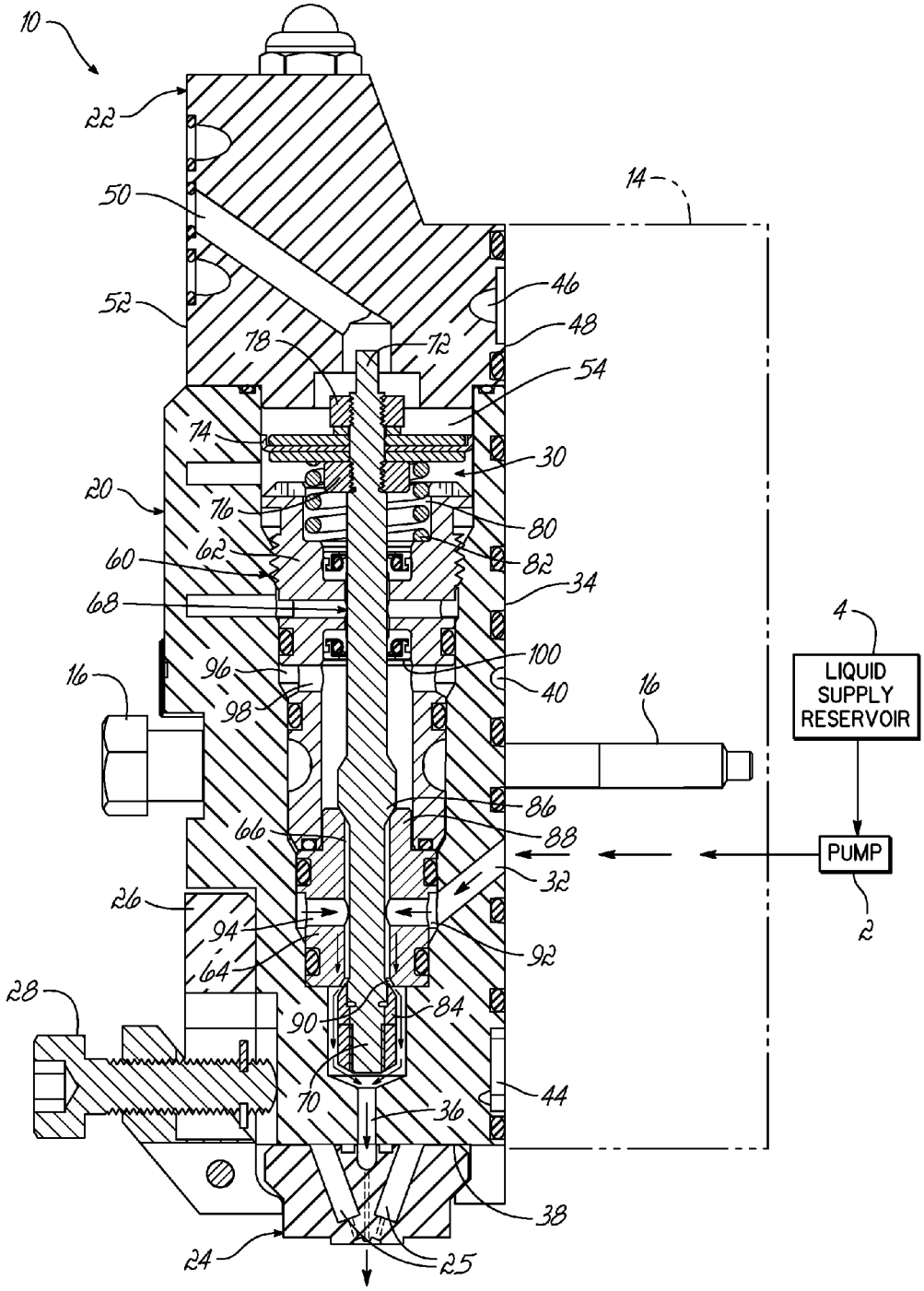
FIG. 1B is a side cross-sectional view taken along line 1B-1B of the valve module and applicator manifold of FIG. 1A, showing the valve module in a liquid dispensing mode.

The dispensing applicator of this embodiment has a generalized body that includes the module body 20. Referring to FIG. 1B, the module body 20 includes a main internal chamber 30. A liquid supply inlet passage 32 extends inwardly through a lower-medial portion of a back face 34 of the module 10, and angularly downward to communicate with the main chamber 30. The liquid supply inlet passage 32 is adapted to receive liquid material delivered from the supply reservoir 4 by the pump 2, and further adapted to direct the liquid material toward the main chamber 30. A liquid dispensing outlet passage 36 extends downwardly from the main chamber 30 and opens to a bottom face 38 of the module body 20. The dispensing outlet passage 36 is adapted to direct liquid material into internal passages 25 of the dispensing nozzle 24 during the liquid dispensing mode. A liquid recirculation outlet passage 40, shown best in FIG. 1D, extends angularly through an upper-medial portion of the back face 34 and communicates with the main chamber 30. The liquid recirculation outlet passage 40 is adapted to direct liquid material from the module 10 toward a liquid recirculation channel 42 extending lengthwise through the manifold 14, as shown schematically in FIGS. 1C and 1D, during the liquid recirculation mode. The module body 20 may further include a pattern air inlet 44 that extends through a lower portion of the back face 34 and communicates with the dispensing outlet passage 36. The pattern air inlet 44 is adapted to receive a supply of pattern air for producing a liquid spray pattern, as described below.

The air cap 22 coupled to the upper portion of the module body 20 includes an actuating air inlet 46 that extends through a back face 48 and is adapted to receive a supply of pressurized actuating air for shifting the valve module 10 between the liquid dispensing mode and the liquid recirculation mode, described below. The air cap 22 further includes an actuating air passage 50 extending through a front face 52 and communicating with an air chamber 54 defined between the module body 20 and the air cap 22, as described below. The front face 52 is adapted to receive a solenoid valve assembly (not shown) having one or more internal air passages that communicate with the actuating air passage 50. An isolation plate (not shown) may be positioned between the solenoid valve assembly and the front face 52 of the air cap 22, and may include an internal air passage that communicates with the internal air passage of the solenoid valve assembly and with the actuating air passage 50 of the air cap 22. The solenoid valve assembly is operable to selectively direct the incoming actuating air into the air chamber 54 to actuate internal components of the valve module 10, described below, to shift the module 10 between the liquid dispensing mode and the liquid recirculation mode.

The main chamber 30 of the module body 20 receives a valve stem casing 60, shown in the form of a removable cartridge. The removable cartridge 60, in combination with the module body 20, defines a plurality of internal liquid chambers and passages, described below. The removable cartridge 60 includes an upper cartridge portion 62, a lower cartridge portion 64, and a central through-bore 66 extending axially through the upper and lower cartridge portions 62, 64 and adapted to receive a valve stem 68. The valve stem 68 is actuatable through the through-bore 66 along a central axis of the cartridge 60 for switching the module 10 between the liquid dispensing mode in which the valve stem 68 is in a downward open position shown in FIG. 1B, and the liquid recirculation mode in which the valve stem 68 is in an upward closed position, shown in FIG. 1C.

The valve stem 68 includes a lower stem end 70 extending through the lower cartridge portion 64 and an upper stem end 72 extending through the upper cartridge portion 62 and into the air chamber 54. The air chamber 54 is defined collectively by an inner surface of the module body 20 defining the main chamber 30, a lower surface of the air cap 22, and a piston 74. The piston 74 is mounted to the valve stem 68 at the upper stem end 72 and is secured between a lower locking nut 76 and an upper locking nut 78. The piston 74 is movable within the air chamber 54 along the cartridge axis with the valve stem 68.

The upper cartridge portion 62 includes an upper recess 80 that receives a coil compression spring 82. The coil spring 82 encircles the valve stem 68 and includes a lower end that abuts the upper cartridge portion 62 and an upper end that abuts the piston 74. The coil spring 82 exerts a bias force on the piston 74 and the valve stem 68 in the direction of the upward closed position shown in FIG. 1C.

The valve stem 68 further includes a lower valve member 84 projecting radially outward from the valve stem 68 near the lower stem end 70, and an upper valve member 86 projecting radially outward from the valve stem 68 at a location between the lower stem end 70 and the upper stem end 72. The lower cartridge portion 64 includes an upper valve seat 88 shaped to sealingly engage the upper valve member 86 when the valve stem 68 is in the downward open position shown in FIG. 1B. The lower cartridge portion 64 further includes a lower valve seat 90 shaped to sealingly engage the lower valve member 84 when the valve stem 68 is in the upward closed position shown in FIG. 1C.

The lower cartridge portion 64, in combination with an inner surface of the module body 20 defining the main chamber 30, defines an annular liquid supply chamber 92 that communicates with the liquid supply inlet passage 32.

A plurality of circumferentially spaced radial passages 94 extend radially inward from the liquid supply chamber 92 toward the valve stem 68, through the lower cartridge portion 64, and open to the central through-bore 66. In the embodiment shown, the cartridge 60 includes four radial passages 94 circumferentially spaced at ninety degree intervals. In alternative embodiments, the cartridge 60 may include any suitable number of radial passages 94 spaced circumferentially at any suitable intervals.

The upper cartridge portion 62, in combination with the inner surface of the module body 20 defining the main chamber 30, defines an annular liquid recirculation chamber 96 that communicates with the liquid recirculation outlet passage 40. A plurality of circumferentially spaced radial passages 98 extend radially inward from the recirculation chamber 96 toward the valve stem 68, through the upper cartridge portion 62, and open to the central through-bore 66. In the embodiment shown, the upper cartridge portion 62 includes four radial passages 98 circumferentially spaced at ninety degree intervals. In alternative embodiments, the upper cartridge portion 62 may include any suitable number of radial passages 98 spaced circumferentially at any suitable intervals.

Referring to FIG. 1B, the valve module 10 is shown in the liquid dispensing mode. To achieve this mode, pressurized actuating air received through the actuating air inlet 46 of the air cap 22 is directed by the solenoid valve assembly through the actuating air passage 50 and into the air chamber 54. The pressurized air forces the piston 74 and the valve stem 68 to move, against the bias forced exerted by the coil spring 82, into the downward open position in which the upper valve member 86 sealingly engages the upper valve seat 88. Simultaneously, liquid material is fed by the pump 2 from the liquid supply reservoir 4 to the liquid supply inlet passage 32 at a flow rate designated by an operator. The incoming liquid material is forced inwardly through the liquid supply inlet passage 32, into the annular liquid supply chamber 92, through the radial passages 94, and into the central through-bore 66, as indicated by directional arrows. The liquid material is then directly downwardly past the lower valve member 84 and through the dispensing outlet passage 36 toward the dispensing nozzle 24. At this stage, the liquid material may be mixed with pattern air received through the pattern air inlet 44, so as to produce a spray pattern as the liquid material is forced through the internal passages 25 of the dispensing nozzle 24 and dispensed onto a substrate.

As the liquid material is forced downwardly past the lower valve member 84 and through the dispensing outlet passage 36 and the dispensing nozzle 24, it is subjected to a first pressure, referred to as a dispensing pressure (also known as an application pressure). As described above, the dispensing pressure is a combined result of a flow rate pressure and a dispensing backpressure. The flow rate pressure is a function of forces exerted on the liquid material by the liquid pump 2 operating at a given liquid flow rate. The dispensing backpressure is a function of forces exerted on the liquid material by the inner surfaces of the passages and chambers through which the liquid material is forced during dispense, including the dispensing outlet passage 36 and the internal passages 25 of the dispensing nozzle 24.

Figure 1C:
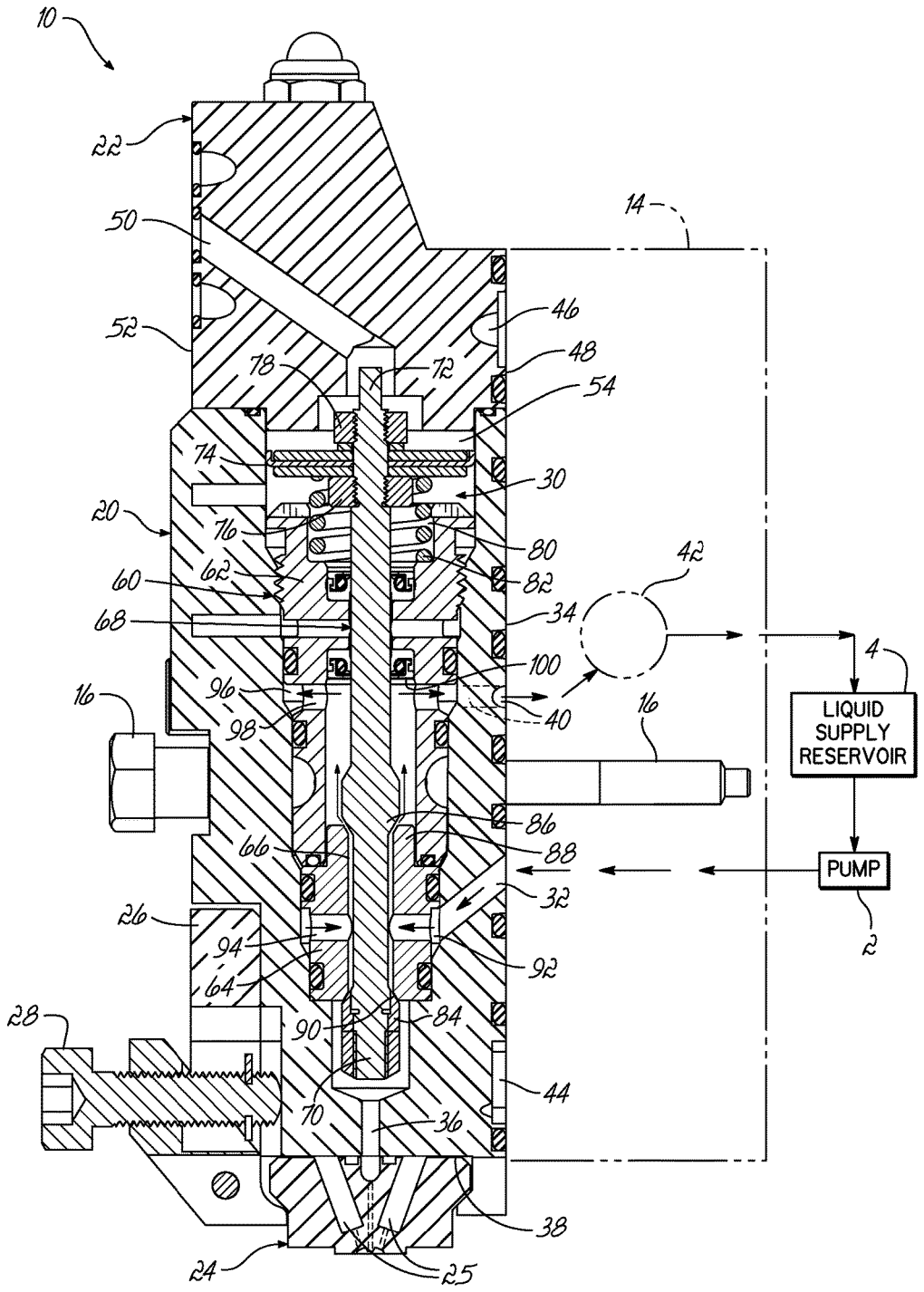
FIG. 1C is a side cross-sectional view similar to FIG. 1B, but showing the valve module in a liquid recirculation mode.
Figure 1D:
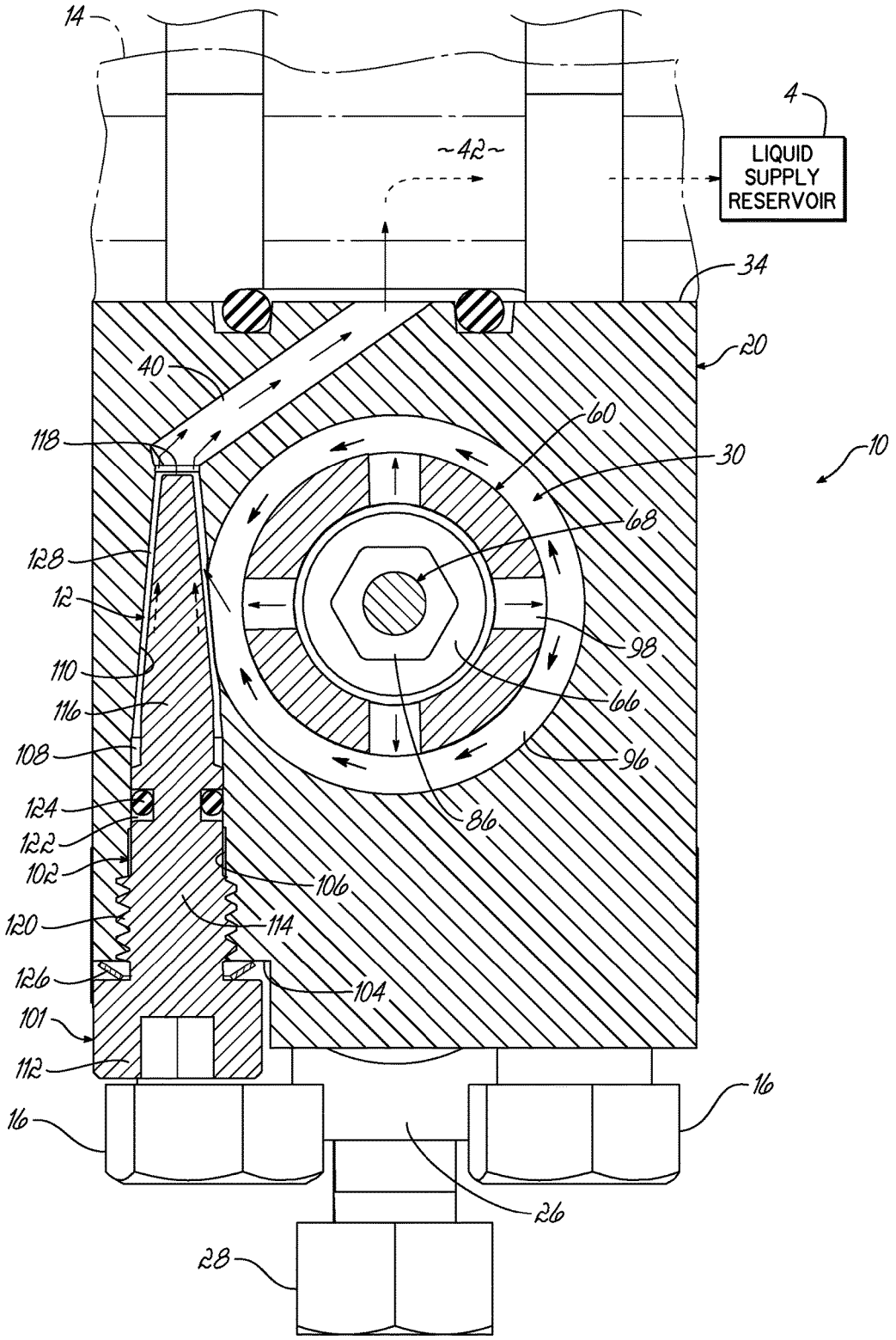
FIG. 1D is a top cross-sectional view taken along line 1D-1D of the valve module and applicator manifold of FIG. 1A, showing the valve module in the liquid recirculation mode.

Referring to FIGS. 1C and 1D, the valve module 10 is shown in the liquid recirculation mode. To achieve this mode, the solenoid valve assembly ceases delivery of pressurized actuating air into the air chamber 54, thereby enabling the coil spring 82 to force the piston 74 and the valve stem 68 into the upward closed position in which the lower valve member 84 sealingly engages the lower valve seat 90. Consequently, the liquid material forced into the central through-bore 66 from the radial passages 94, as described above, is directly upwardly past the upper valve member 86, through the radial passages 98, and into the annular liquid recirculation chamber 96, as indicated by directional arrows. An upper seal 100 encircling and sealingly contacting the valve stem 68 blocks liquid material from flowing axially upward through the central through-bore 66 beyond the radial passages 98. As shown in FIG. 1D, the liquid material is then directed from the recirculation chamber 96 through a tapered annular space 128 of the recirculation backpressure control device 12, and through the liquid recirculation outlet passage 40. From the liquid recirculation outlet passage 40, the liquid material is directed into the recirculation channel 42 formed in the manifold 14 of the applicator. The liquid material is then pumped from the manifold 14 into a recirculation conduit (not shown), such as an external hose, through which the liquid material flows back toward the liquid material supply reservoir 4.

As the liquid material is forced through the various chambers and passages described above and into the recirculation channel 42, the liquid material is subjected to a second pressure, referred to as a recirculation pressure. As described above, the recirculation pressure is a combined result of the flow rate pressure and a recirculation backpressure. The recirculation backpressure is a function of forces exerted on the liquid material by the inner surfaces of the passages and chambers through which the liquid material is forced during recirculation, including the recirculation outlet passage 40, the tapered annular space 128, and the recirculation channel 42. As described below, the recirculation backpressure may be selectively controlled, or predetermined, by adjusting the cross-sectional area, and thus the volume, of the tapered annular space 128.

As shown in FIG. 1D, the recirculation backpressure control device 12 is in the form of an adjustable needle valve including a needle 101 and a valve port 102 in which the needle 101 is received, the valve port 102 being formed in the module body 20. The valve port 102 opens to a front surface 104 on the module body 20 and communicates with the recirculation outlet passage 40 and the annular recirculation chamber 96. The valve port 102 includes a threaded counterbore 106 extending through the front surface 104 in a direction toward the back face 34, a cylindrical bore 108 extending from the counterbore 106, and a tapered bore 110 extending from the cylindrical bore 108. As shown, the tapered bore 110 opens laterally to the annular recirculation chamber 96 and opens distally to the recirculation outlet passage 40.

The needle 101 includes a head 112, a cylindrical medial portion 114 extending from the head 112, and a tapered portion 116 extending from the cylindrical medial portion 114 and defining a needle tip 118. The cylindrical medial portion 114 includes a thread 120 that threadedly engages the threaded counterbore 106 of the valve port 102, and an annular notch 122 adapted to receive a sealing element 124 for sealingly engaging the cylindrical bore 108 of the valve port 102. The tapered portion 116 is received within the tapered bore 110 of the valve port 102.

A shim washer 126 may be positioned between the head 112 of the needle 101 and the front surface 104 of the module body 20. When the needle 101 is tightened against the shim washer 126, the shim washer 126 exerts an outwardly directed force on the needle head 112. Accordingly, the shim washer 126 secures the needle 101 in a desired rotational orientation and mitigates unintended rotation of the needle 101 due to vibrations or other movement associated with operation of the valve module 10. The shim washer 126 may be formed with any suitable thickness and may be curved, waved, or flat, for example. Furthermore, multiple shim washers 126 may be used when suitable.

A tapered annular space 128 is defined between the tapered portion 116 of the needle 101 and the tapered bore 110 of the valve port 102. The tapered annular space 128 defines a device passage of the recirculation backpressure control device 12 through which the liquid material is directed in the liquid recirculation mode. The needle 101 may be selectively rotated to increase or decrease the cross-sectional area and volume of the tapered annular space 128, and thereby increase or decrease the recirculation backpressure experienced by the liquid material as it passes through tapered annular space 128 and the recirculation outlet passage 40. In this manner, liquid material flowing through the valve module 10 may be provided with a recirculation backpressure that is predetermined.

In particular, the needle 101 may be rotated in a first direction (e.g., clockwise) to advance the tapered portion 116 of the needle 101 further into the tapered bore 110 of the valve port 102, thereby reducing the cross-sectional area and volume of the tapered annular space 128. Consequently, in the recirculation mode the liquid material is forced through a passage, defined by the tapered annular space 128, having a reduced volume, thereby increasing the recirculation backpressure. Alternatively, the needle 101 may be rotated in a second direction (e.g., counter-clockwise) opposite the first direction to withdraw the tapered portion 116 of the needle 101 away from the tapered bore 110 of the valve port 102, thereby increasing the cross-sectional area and volume of the tapered annular space 128. Consequently, in the recirculation mode the liquid material is forced through a passage, defined at least in part by the tapered annular space 128, having an increased volume, thereby decreasing the recirculation backpressure.

In alternative embodiments, the needle 101 and the valve port 102 may be formed without tapered features, including the tapered portion 116 and the tapered bore 110. For example, the needle 101 and the valve port 102 may be substantially cylindrically shaped. In such embodiments, the needle 101 may be selectively rotated as described above, or otherwise moved, to adjust a length of the needle 101 that is received within the valve port 102. Thereby, a corresponding volume of space through which the liquid material flows in the recirculation mode, including a cylindrical annular space similar to annular space 128, may be selectively adjusted so as to achieve a particular, predetermined recirculation backpressure. It will be understood that such alternative configurations of recirculation backpressure control devices having non-tapered features may be applied to the embodiment described below in connection with FIGS. 4A-4C as well.

Selective adjustment of the needle 101 within the valve port 102 enables approximate matching of the recirculation backpressure to the dispensing backpressure corresponding to the valve module 10, thereby effectively neutralizing a pressure differential between these two backpressures. For example, if the module 10 is fitted with a new dispensing nozzle 24 having different internal geometry so as to effectively increase or decrease the dispensing backpressure of the module 10, the needle 101 may be selectively adjusted to match the recirculation backpressure to the new dispensing backpressure.

Furthermore, where the dispensing applicator includes multiple valve modules 10, each feeding into a common recirculation channel 42 formed in the applicator manifold 14, each module 10 may be provided with its own adjustable needle valve 12. Each module 10 may be operated at a unique liquid flow rate and/or fitted with a unique dispensing nozzle 24, such that liquid material flowing through each module 10 experiences a unique recirculation pressure and/or a unique dispensing pressure, including a unique dispensing backpressure. Advantageously, the needle 101 of each module 10 may be independently adjusted so as to control the recirculation backpressure of that module 10 and approximately match the recirculation backpressure to the dispensing backpressure of that module 10, thereby neutralizing a differential between the two backpressures. In this manner, the recirculation flow path corresponding to each module 10 may be independently tuned so that the collective plurality of modules 10 on the applicator may operate concurrently with improved dispensing performance.

As described above, neutralizing the dispensing backpressure and the recirculation backpressure of a valve module improves precision and accuracy of the volumetric output of dispensed liquid material. This result may be particularly advantageous when dispensing hot liquid material onto heat-sensitive substrates, such as thin nonwoven materials, which are vulnerable to damage when dispensed upon with excessive amounts of hot liquid material, for example caused by inaccurate dispensing operations.

Figure 2A:
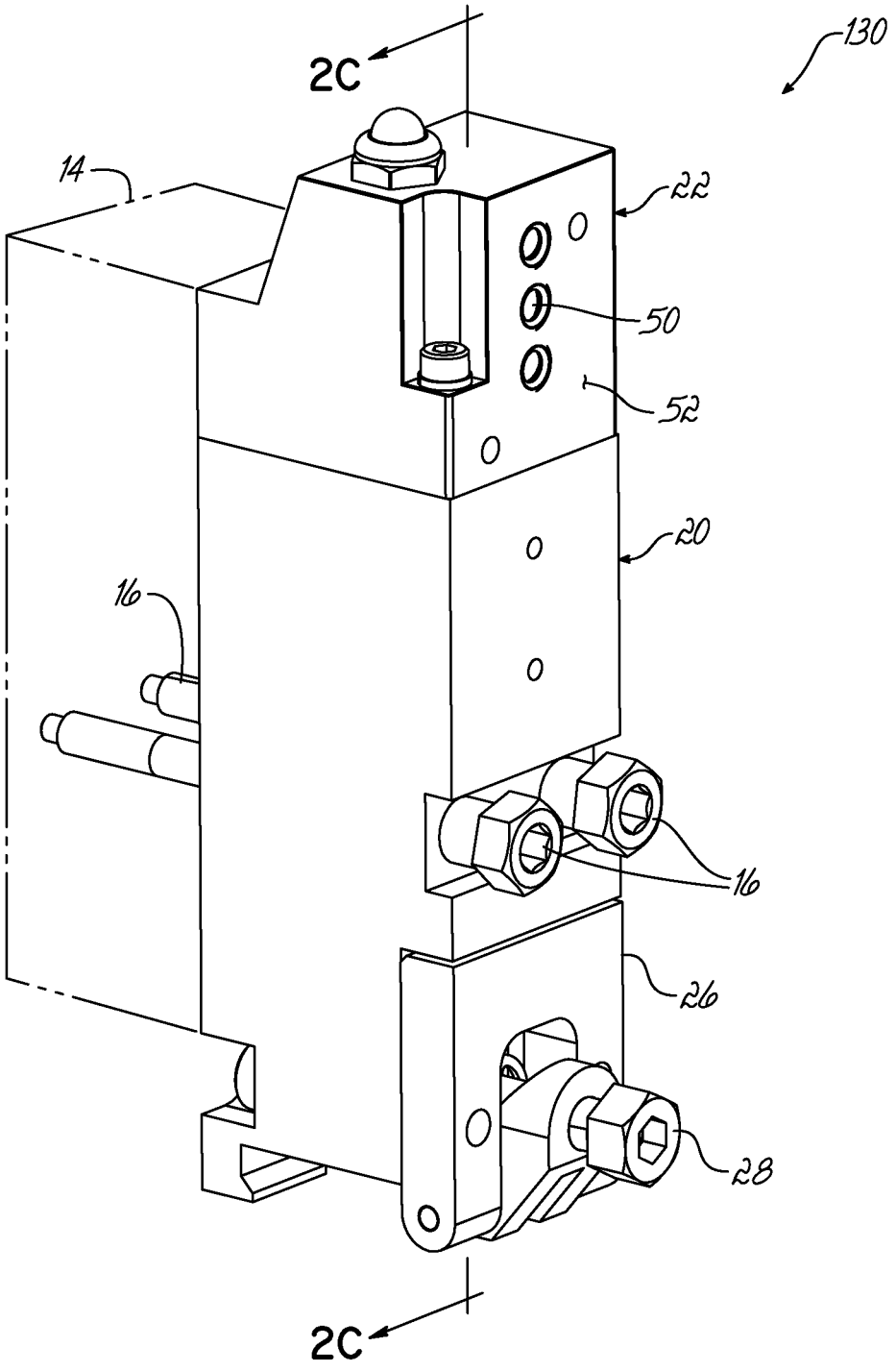
FIG. 2A is a front perspective view of a face-mount-style valve module coupled with an applicator manifold, shown schematically, and provided with a fixed recirculation backpressure control device in accordance with a second embodiment of the invention.
Figure 2B:
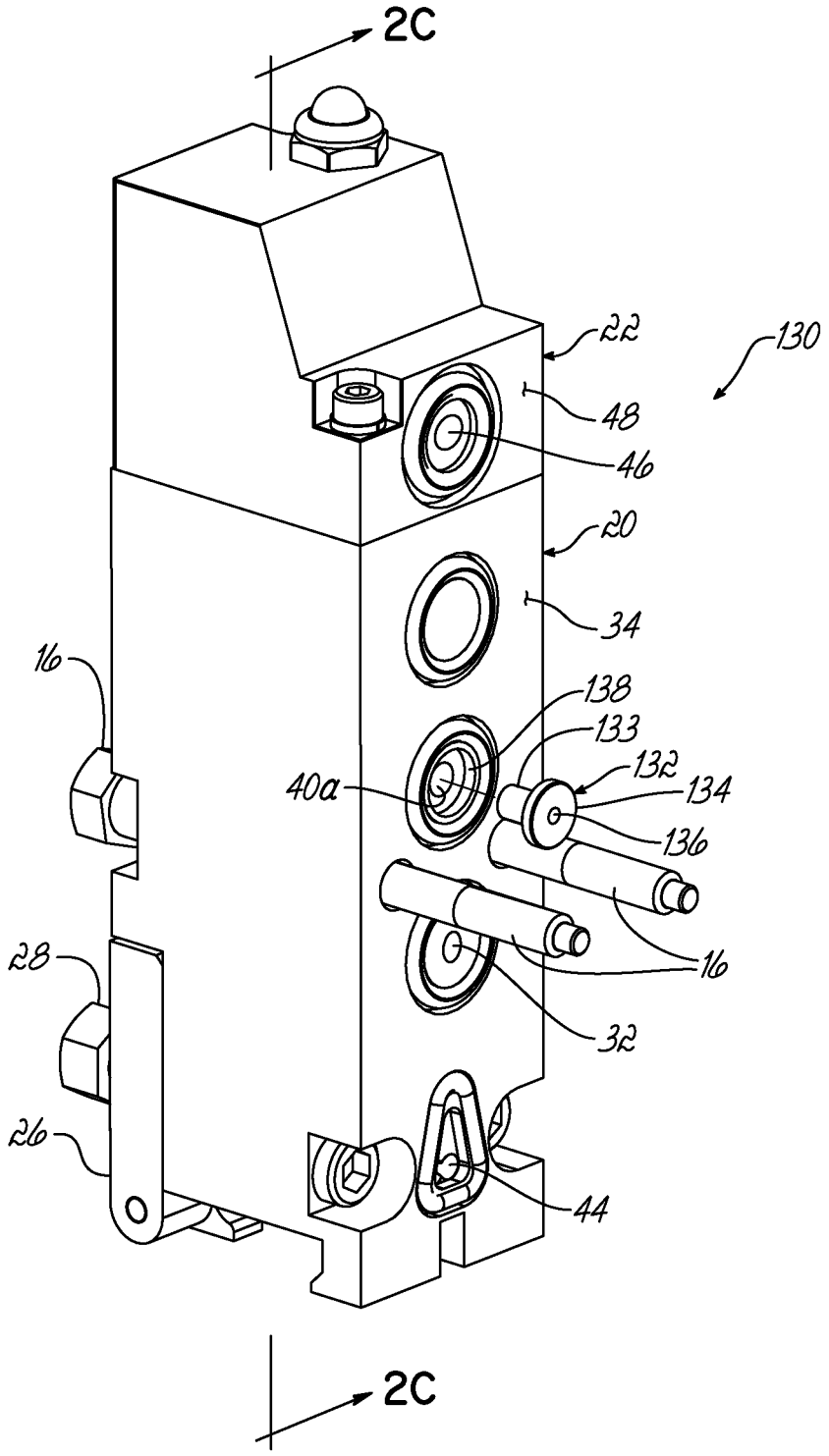
FIG. 2B is a rear perspective view of the valve module of FIG. 2A, showing the fixed recirculation backpressure control device removed from and aligned with a liquid recirculation outlet passage of the valve module.
Figure 2C:
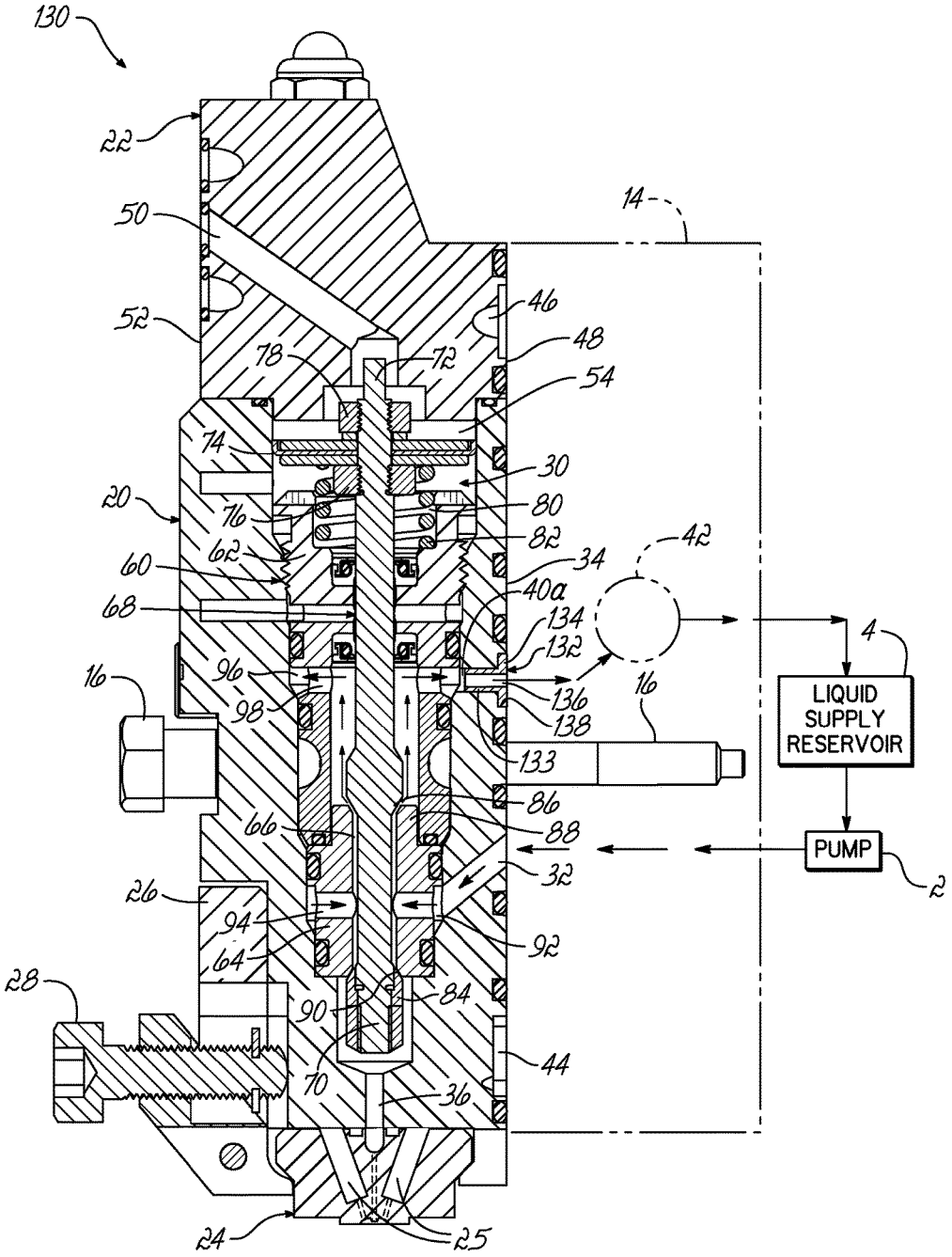
FIG. 2C is a side cross-sectional view taken along line 2C-2C of the dispending module of FIG. 2B, showing the fixed recirculation backpressure control device received within the liquid recirculation outlet passage of the valve module, and showing the valve module in the liquid recirculation mode.

Referring to FIGS. 2A-2C, a second embodiment of a valve module 130 provided with a fixed recirculation backpressure control device 132 is shown. The valve module 130 is similar in construction to valve module 10 shown in FIGS. 1A-1D, except as otherwise described below. In that regard, similar reference numerals refer to similar features shown and described in connection with FIGS. 1A-1D.

Referring to FIG. 2B, the fixed recirculation backpressure control device 132 is in the form of a restrictor insert having a tubular body 133, a flange 134 extending radially outward from an end of the tubular body 133, and a central bore 136 extending axially through the tubular body 133 along a length of the restrictor insert 132. As shown in FIGS. 2B and 2C, the tubular body 133 is inserted into an outer portion of a liquid recirculation outlet passage 40*a* such that the flange 134 is received in a counterbore 138 formed in the back face 48 of the module 130. The counterbore 138 may be formed with a depth such that the flange 134 lies flush with the back face 48. Additionally, as shown, the central bore 136 of the restrictor insert 132 communicates with an inner portion of the liquid recirculation outlet passage 40*a* and with the annular recirculation chamber 96.

While the tubular body 133 and the flange 134 of the restrictor insert 132 are shown with circular cross-sectional shapes, it will be understood that these portions of the restrictor insert 132 may be formed with any suitable cross-sectional shapes. Additionally, the restrictor insert 132 may be formed without the flange 134.

Referring to FIG. 2C, showing the valve module 130 in the liquid recirculation mode, the annular recirculation chamber 96 is in direct communication with the liquid recirculation outlet passage 40*a*. Accordingly, in the liquid recirculation mode liquid material may flow directly from the annular recirculation chamber 96 into the liquid recirculation outlet passage 40*a*, and through the central bore 136 of the restrictor insert 132. In this regard, the central bore 136 of the recirculation backpressure control device 132 defines a device passage through which the liquid material is directed in the liquid recirculation mode. As shown, the central bore 136 is formed with a fixed diameter that is smaller than those of the radial passages 98 and the recirculation outlet passage 40*a*. Accordingly, inclusion of the restrictor insert 132 results in the liquid material being forced through a passage, defined by the central bore 136, having a reduced cross-sectional area and volume as compared to an embodiment in which the restrictor insert 132 is omitted. As a result, the recirculation backpressure is increased.

The central bore 136 of the restrictor insert 132 may be formed with any suitable diameter, chosen for providing a predetermined recirculation backpressure that approximately matches a specific dispensing backpressure of the module 130, which is determined by the factors described above. For example, if the dispensing nozzle 24 is substituted for another nozzle having different internal geometry, the module 130 may be fitted with a restrictor insert 132 having a bore 136 with a diameter suitably sized for approximately matching the new dispensing backpressure. In this manner, inclusion of the restrictor insert 132 enables control of the recirculation backpressure to approximately match the dispensing backpressure, and thereby neutralize a pressure differential between the dispensing and recirculation backpressures.

Additionally, a dispensing applicator may include multiple valve modules 130, each module 130 including a respective restrictor insert 132 having a central 136 sized and shaped for approximately matching the recirculation backpressure of the module 130 to the dispensing backpressure of the module 130. Accordingly, even where one or more of the modules 130 on the applicator is operated at a unique liquid flow rate and/or fitted with a unique dispensing nozzle 24, the recirculation backpressure of each module 130 may be independently controlled so as to approximately neutralize a differential between the recirculation and dispensing pressures of that module 130. In this manner, the collective plurality of modules 130 on the applicator may operate concurrently with improved dispensing performance.

It will be understood that an applicator according to an alternative embodiment may include one or more valve modules 10 and one or more valve modules 130. Accordingly, the applicator may include backpressure control devices in the form of one or more adjustable needle valves 12 and one or more fixed restrictor inserts 132, each backpressure control device 12, 132 configured to approximately neutralize a differential between the recirculation and dispensing pressures of its respective valve module 10, 130.

Figure 3A:
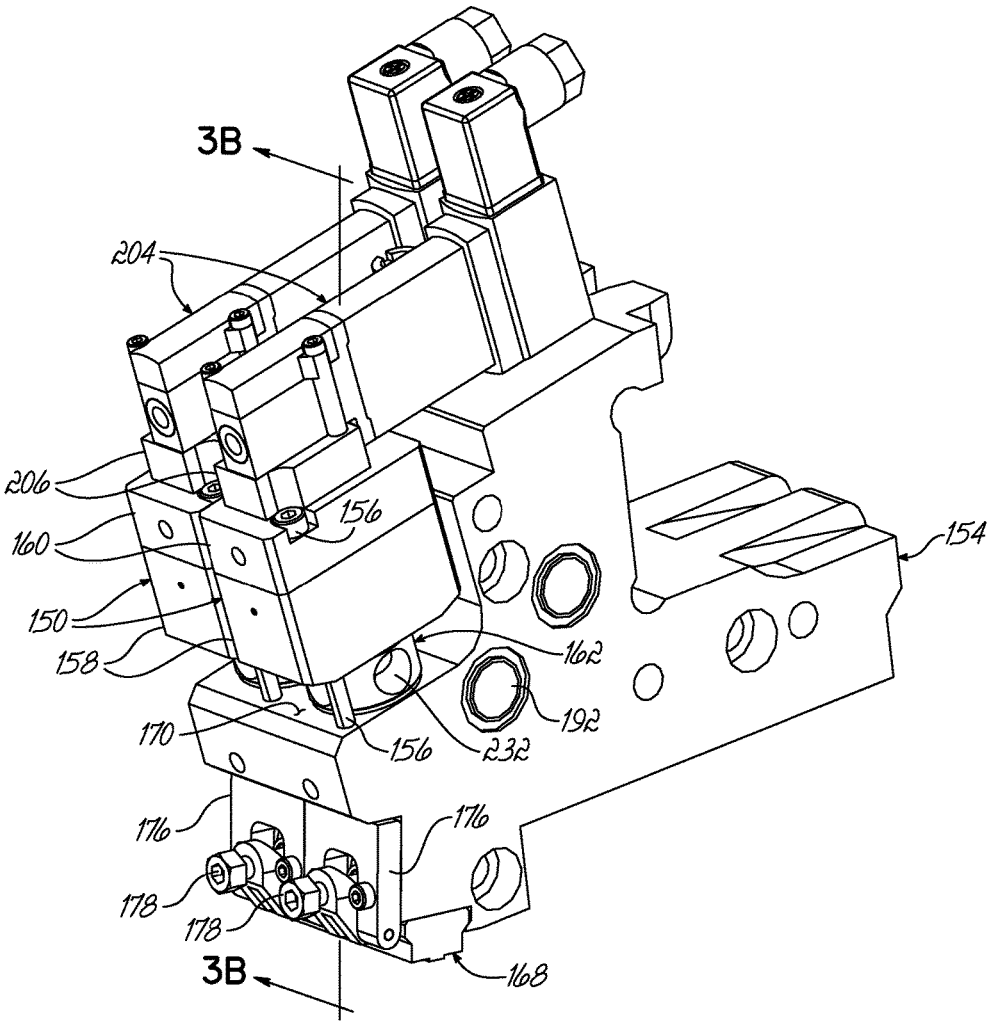
FIG. 3A is a front perspective view of an insert-style valve module coupled with an applicator manifold, in combination with a fixed recirculation backpressure control device in accordance with a third embodiment of the invention.
Figure 3B:
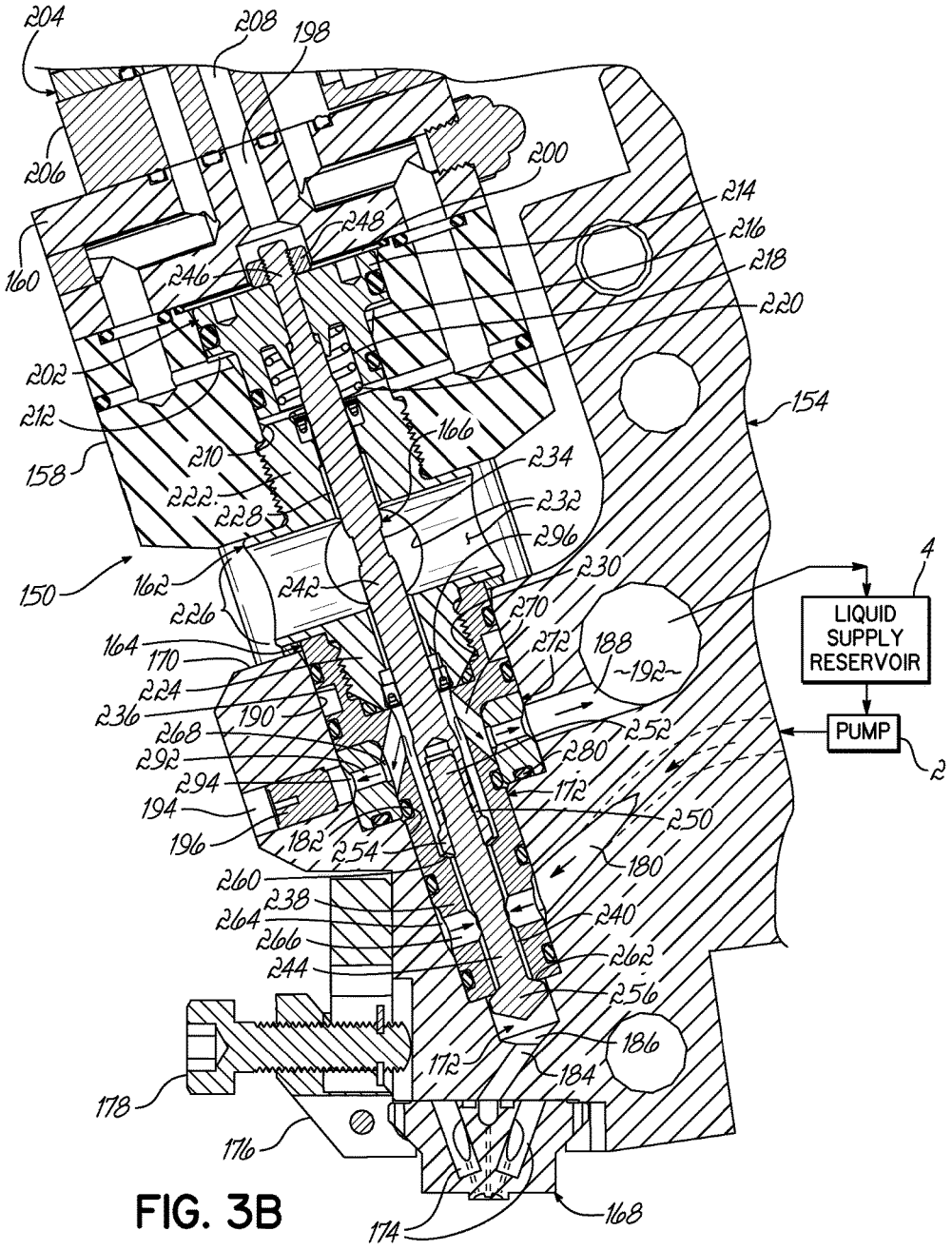
FIG. 3B is an enlarged side cross-sectional view taken along line 3B-3B of the valve module and applicator manifold of FIG. 3A, showing the valve module in a liquid recirculation mode.
Figure 3C:
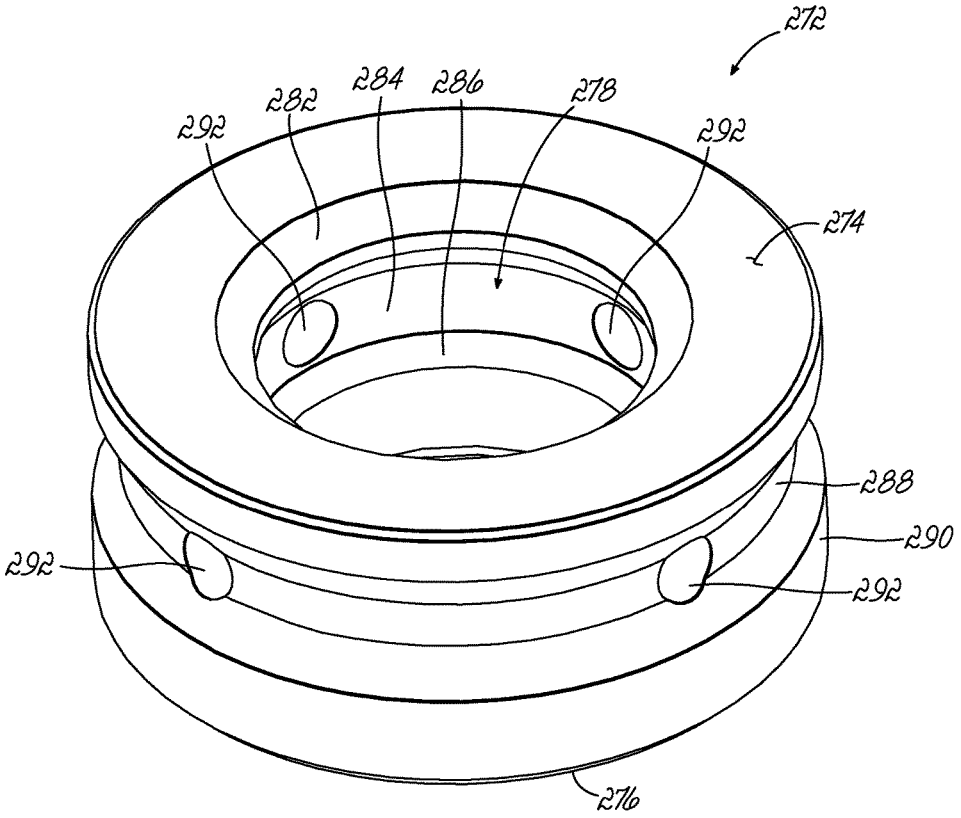
FIG. 3C is a perspective view of the fixed recirculation backpressure control device of FIG. 3B.

Referring to FIGS. 3A-3C, a third embodiment of a valve module 150 and a fixed recirculation backpressure control device 272 is shown. FIG. 3A shows two identical valve modules 150 arranged side-by-side and mounted to a manifold 154, shown as a manifold segment, of a liquid dispensing applicator using mounting bolts 156. In contrast to the self-contained, face-mount-style valve modules 10, 130 shown in FIGS. 1A-2C that mount to the manifold 14 at a single back face 48, the valve module 150 shown in FIGS. 3A-3C (and module 300 shown in FIGS. 4A-4C) is an insert-style module. In that regard, module 150 (and module 300) includes a lower portion that is inserted into a chamber formed in the manifold 154 of the dispensing applicator, as described in greater detail below.

The dispensing applicator of this embodiment has a generalized body that includes the manifold 154, which may have multiple manifold segments 154 arranged in side-by-side relation. As shown in FIG. 3A, each manifold segment 154 may receive and operatively couple to one or more valve modules 150. In alternative embodiments, the manifold segment 154 shown herein may be an integral portion of a monolithic manifold formed as a single unitary piece of the dispensing applicator, and to which two or more valve modules 150 may be mounted in side-by-side relation. In that regard, it will be understood that the various features of the embodiments of the invention described herein may be adapted for liquid dispensing applicators having manifolds of various configurations.

The valve module 150 includes a series of components extending coaxially along a central module axis. In particular, the module 150 includes an upper housing 158, an air cap 160 operatively coupled to an upper end of the upper housing 158, a valve stem guide 162 coupled to a lower end of the upper housing 158, a valve stem casing 164 coupled to the valve stem guide 162, and a valve stem 166 extending through the valve stem guide 162 and the valve stem casing 164 along the module axis. Similar to the valve modules 10, 130 described above, valve module 150 is operable in a liquid dispensing mode in which liquid material pumped to the module 150 from liquid supply reservoir 4 with liquid pump 2 is dispensed from a dispensing nozzle 168. The valve module 150 is also operable in a recirculation mode in which the liquid material pumped to the module 150 is circulated back toward the supply reservoir 4, as described in greater detail below. The valve stem 166 may be placed into a downward open position (not shown) similar to that shown in FIG. 1B to establish the liquid dispensing mode, and into an upward closed position shown in FIG. 3B, similar to that shown in FIG. 1C, to establish the liquid recirculation mode.

As shown in FIGS. 3A and 3B, the manifold segment 154 includes a mounting surface 170 to which the module 150 may be mounted and secured with the mounting bolts 156. The manifold segment 154 also includes a module socket 172 that extends through the mounting surface 170 and that is sized and shaped to receive the valve stem casing 164 in sealing contact. As shown, the valve stem casing 164 is fully seated within the module socket 172 such that a medial portion 226 of the valve stem guide 162, described below, confronts and overlies the mounting surface 170. The dispensing nozzle 168 is releasably coupled to a lower end of the manifold segment 154 with a nozzle retaining clamp 176 having a clamp screw 178. As described above in connection with module 10, the manifold segment 154 of this embodiment may be fitted with dispensing nozzles of various configurations for various dispensing applications.

Referring to FIG. 3B, the manifold segment 154 further includes a liquid supply inlet passage 180 extending angularly relative a length and width of the manifold segment 154, and opening to a lower socket portion 182 of the module socket 172. The liquid supply inlet passage 180 is adapted to receive liquid material delivered from the supply reservoir 4 by the pump 2, and to direct the incoming liquid material toward the module socket 172. A liquid dispensing outlet passage 184 extends angularly downward from a bottom end 186 of the module socket 172 and opens to a bottom surface of the manifold segment 154 where the dispensing nozzle 168 is mounted. The dispensing outlet passage 184 is adapted to direct liquid material into the dispensing nozzle 168 during the liquid dispensing mode, as described below.

The manifold segment 154 further includes a liquid recirculation outlet passage 188 that extends radially outward from an upper socket portion 190 of the module socket 172 and opens to a recirculation channel 192 extending lengthwise through the manifold segment 154. The recirculation outlet passage 188 is adapted to direct liquid material from the module 150 into the recirculation channel 192 during the recirculation mode, as described below. The recirculation outlet passage 188 may be formed by inserting a tool piece through a front drain port 194, which may be sealed with a drain plug 196 to prevent liquid material from escaping through the drain port 194 during operation of the valve module 150.

The features of the applicator manifold 154 described above correspond to a single module location along a length of the manifold segment 154 at which a valve module 150 is positioned. It will be understood that similar features may be provided at each additional module location along the length of the manifold 154 at which additional valve modules 150 are mounted. In that regard, it will also be understood that the recirculation channel 192 may extend along a length of the applicator manifold 154 such that it communicates directly with a recirculation outlet passage 188 extending from a module socket 172 corresponding to each module location.

Turning now to the structural details of the valve module 150, the air cap 160 coupled to the upper end of the upper housing 158 includes an actuating air inlet (not shown) that is adapted to receive a supply of pressurized actuating air for shifting the valve module 150 between the liquid dispensing mode and the liquid recirculation mode. An actuating air passage 198 extends through the air cap 160 and communicates with an air chamber 200 defined between the air cap 160, the upper housing 158, and a piston member 202 received within the upper housing 158 and coupled to the valve stem 166. A solenoid valve assembly 204 is operatively coupled to the air cap 160 and has an internal air passage (not shown) that communicates with the actuating air passage 198 of the air cap 160. A heat isolation plate 206 may be positioned between the solenoid valve assembly 204 and the air cap 160. The heat isolation plate 206 includes an internal air passage 208 that communicates at an upper end with the internal air passage of the solenoid valve assembly 204, and communicates at a lower end with the actuating air passage 198 of the air cap 160. The solenoid valve assembly 204 is operable to selectively direct the incoming actuating air into the air chamber 200 to actuate the valve stem 166, via the piston member 202, for shifting the module 150 between the liquid dispensing mode and the liquid recirculation mode, as described below.

The upper housing 158 is coupled to a lower end of the air cap 160 and includes a housing through-bore 210 that opens to an upper counterbore 212, each extending along the module axis. The counterbore 212 and an upper portion of the housing through-bore 210 are sized and shaped to receive the piston member 202 in sliding engagement. In particular, the counterbore 212 is sized and shaped to receive an upper flange 214 of the piston member 202, and the upper portion of the housing through-bore 210 is sized and shaped to receive a lower cylindrical body 216 of the piston member 202. The piston member 202 is coupled to the valve stem 166 and is moveable with the valve stem 166 along the module axis. The piston member 202 includes a lower recess 218 sized to receive an upper end of a compression coil spring 220 that encircles the valve stem 166. A lower end of the coil spring 220 abuts an upper end of an upper portion of the valve stem guide 162. Accordingly, the coil spring 220 exerts an upward bias force on the piston member 202 so as to bias the piston member 202 and the valve stem 166 toward the upward closed position, as shown in FIG. 3B.

The valve stem guide 162 includes an upper guide portion 222, a lower guide portion 224, and a medial guide portion 226 formed between the upper and lower guide portions 222, 224. The valve stem guide 162 further includes a guide through-bore 228 extending along the module axis and being sized to receive the valve stem 166. The upper guide portion 222 includes an external thread that threadedly engages an inner thread formed in a lower portion of the housing through-bore 210. Similarly, the lower guide portion 224 includes an external thread that threadedly engages an inner thread formed in an upper recess 230 of the valve stem casing 164. The lower portion of the guide through-bore 228 and the upper recess 230 of the valve stem casing 164 are sized and shaped to receive the upper guide portion 222 and the lower guide portion 224, respectively. The medial guide portion 226 includes a plurality of circumferentially spaced bores 232 extending radially inward toward and opening to the guide through-bore 228, thereby providing access to an annular notch 234 formed on the valve stem 166.

The valve stem casing 164 includes an upper casing portion 236 and a lower casing portion 238 that is smaller in diameter than the upper casing portion 236. As shown, the upper casing portion 236 is received within the upper socket portion 190 of the module socket 172, and the lower casing portion 238 is received within the lower socket portion 182. A casing through-bore 240 extends through the valve stem casing 164 along the module axis and is sized to receive the valve stem 166.

The valve stem 166 extends along the module axis and includes an upper stem portion 242 and a lower stem portion 244 coupled to the upper stem portion 242, for example through a threaded engagement. An upper end 246 of the upper stem portion 242 is formed with a reduced diameter and extends axially through the piston member 202, and is coupled to the piston member 202 with the assistance of a locking nut 248. A lower end 250 of the upper stem portion 242 includes a bore that receives an upper end 252 of the lower stem portion 244.

The valve stem 166 further includes an upper valve member 254 projecting radially outward from the lower end 250 of the upper stem portion 242, and a lower valve member 256 projecting radially outward from a lower end of the lower stem portion 244. The lower casing portion 238 includes an upper valve seat 260 shaped to sealingly engage the upper valve member 254 when the valve stem 166 is in the downward open position (not shown), similar to that shown in FIG. 1B. The lower casing portion 238 further includes a lower valve seat 262 shaped to sealingly engage the lower valve member 256 when the valve stem 166 is in the upward closed position, shown in FIG. 3B.

The lower casing portion 238, in combination with an inner surface defining the lower socket portion 182 of the module socket 172, defines an annular liquid supply chamber 264 that communicates with the liquid supply inlet passage 180. A plurality of circumferentially spaced radial passages 266 extend radially inward from the liquid supply chamber 264 toward the valve stem 166, through the lower casing portion 238, and open to the casing through-bore 240. In the embodiment shown, the lower casing portion 238 includes four radial passages 266 circumferentially spaced at ninety degree intervals. In alternative embodiments, the lower casing portion 238 may include any suitable number of radial passages 266 spaced at any suitable intervals.

The upper casing portion 236, in combination with the fixed recirculation backpressure control device 272 described below, defines an inner annular liquid recirculation chamber 268 that communicates with the liquid recirculation outlet passage 188. A plurality of circumferentially spaced angled passages 270 extend radially inward and axially upward from the inner recirculation chamber 268 toward the valve stem 166, through the upper casing portion 236, and open to the casing through-bore 240. In the embodiment shown, the upper casing portion 236 includes four angled passages 270 circumferentially spaced at ninety degree intervals. In alternative embodiments, the upper casing portion 236 may include any suitable number of angled passages 270 spaced circumferentially at any suitable intervals.

Referring to FIGS. 3B and 3C, the fixed recirculation backpressure control device 272 is shown in the form of a recirculation restrictor ring. The recirculation restrictor ring 272 includes an upper annular surface 274, a lower annular surface 276, and a central ring through-bore 278 sized to receive the lower casing portion 238 therethrough. As shown in FIG. 3B, the restrictor ring 272 is received within the upper socket portion 190 such that it encircles an upper end of the lower casing portion 238. The restrictor ring 272 is positioned in the upper socket portion 190 such that the upper annular surface 274 abuts a lower end of the upper casing portion 236 and the lower annular surface 276 abuts a lower end of the upper socket portion 190. The restrictor ring 272 may be formed with an outer diameter substantially equal to that of the upper casing portion 236. Additionally, the lower annular surface 276 may include an annular groove adapted to receive a sealing element 280, such as an o-ring, so that the lower annular surface 276 may sealingly engage the lower end of the upper socket portion 190. The upper annular surface 274 may include a chamfer 282 to accommodate a corresponding radius formed on the valve stem casing 164 between the upper and lower casing portions 236, 238.

The recirculation restrictor ring 272 further includes an inner annular groove 284 formed on a radially inner wall 286, an outer annular groove 288 formed on a radially outer wall 290, and a plurality of circumferentially spaced radial bores 292 extending radially between and opening to the inner annular groove 284 and the outer annular groove 288. As described above, the inner annular groove 284, in combination with the upper casing portion 236, defines the inner annular liquid recirculation chamber 268. The outer annular groove 288, in combination with an inner surface defining the upper socket portion 190 of the module socket 172, defines an outer annular liquid recirculation chamber 294.

As shown in FIGS. 3B and 3C, the recirculation restrictor ring 272 includes four radial bores 292 formed with fixed diameters of equal size and circumferentially spaced at ninety degree intervals. As described below, in alternative embodiments the restrictor ring may be formed with radial bores 292 formed with any suitable diameters and in any suitable quantity and circumferential configuration.

The restrictor ring 272 is positioned relative to the valve stem casing 164 such that each of the radial bores 292 aligns with one of the angled passages 270 of the upper casing portion 236. Additionally, the combined valve stem casing 164 and restrictor ring 272 are positioned within the module socket 172 of the manifold segment 154 such that the one of the radial bores 292 of the restrictor ring 272, and the respective angled passage 270 of the upper casing portion 236, is aligned with the recirculation outlet passage 188.

Providing the valve module 150 in the liquid dispensing mode, while not shown herein, is similar to the process described above in connection with module 10 of FIG. 1B. In particular, pressurized actuating air received through the actuating air inlet of the air cap 160 is directed by the solenoid valve assembly 204 through the actuating air passage 198 and into the air chamber 200. The pressurized air forces the piston member 202 and the valve stem 166, against the bias forced exerted by a coil spring 220, into the downward open position in which the upper valve member 254 sealingly engages the upper valve seat 260. Simultaneously, liquid material is fed by the pump 2 from the liquid material supply 4 to the liquid supply inlet passage 180 at a flow rate designated by an operator. The incoming liquid material is forced inwardly through the liquid supply inlet passage 180, into the annular liquid supply chamber 264, through the radial passages 266 in the lower casing portion 238, and into the casing through-bore 240. The liquid material is then directly downwardly past the lower valve member 256, through the dispensing outlet passage 184, and into the dispensing nozzle 168. At this stage, the liquid material may be mixed with pattern air to produce a certain spray pattern as the liquid material is forced through internal passages 174 of the dispensing nozzle 168 and directed onto a substrate.

As the liquid material is forced downwardly past the lower valve member 256 and through the dispensing outlet passage 184 and the dispensing nozzle 168, the liquid material is subjected to a dispensing backpressure. As described above, the dispensing backpressure is a function of forces exerted on the liquid material by the inner surfaces of the passages and chambers through which the liquid material is forced during dispense, including the dispensing outlet passage 184 and the internal passages 174 of the dispensing nozzle 168.

Providing the valve module 150 in the liquid recirculation mode, shown in FIG. 3B, is similar to the process described above in connection with module 10 of FIG. 1C. In particular, the solenoid valve assembly 204 ceases delivery of pressurized actuating air into the air chamber 200, thereby enabling the coil spring 220 to force the piston member 202 and the valve stem 166 into the upward closed position in which the lower valve member 256 sealingly engages the lower valve seat 262. Consequently, the liquid material forced into the casing through-bore 240 through the radial passages 266, as described above, is redirected upwardly past the upper valve member 254 and into the angled passages 270. An upper seal 296 encircling and sealingly contacting the valve stem 166 blocks the liquid material from flowing axially upward through the through-bore 240 beyond the angled passages 270. The liquid material is forced outwardly through the angled passages 270, into the inner annular recirculation chamber 268, through the radial bores 292 of the recirculation restrictor ring 272, into the outer annular recirculation chamber 294, and into the recirculation outlet passage 188, as indicated by the directional arrows. The recirculation outlet passage 188 directs the liquid material into the recirculation channel 192 extending through the applicator manifold 154. The liquid material is then pumped from the recirculation channel 192 into a recirculation conduit (not shown), such as an external hose, through which the liquid material flows back toward the liquid material supply reservoir 4.

As the liquid material is forced through the various chambers and passages toward and through the recirculation channel 192, the liquid material is subjected to a recirculation backpressure. As described above, the recirculation backpressure is a function of forces exerted on the liquid material by the inner surfaces of the passages and chambers through which the liquid material is forced during recirculation, including the angled passages 270, the inner and outer annular recirculation chambers 268, 294, the radial bores 292 of the restrictor ring 272, the recirculation outlet passage 188, and the recirculation channel 192. In this regard, the inner annular recirculation chamber 268 defined in part by the inner annular groove 284, the outer annular recirculation chamber 294 defined in part by the outer annular groove 288, and the radial bores 292 of the recirculation backpressure control device 272 collectively define a device passage through which the liquid material is directed in the liquid recirculation mode.

Each of the radial bores 292 of the recirculation restrictor ring 272 is formed with a fixed diameter that is smaller than the diameters of the angled passages 270 of the lower casing portion 238 and the recirculation outlet passage 188 in the manifold segment 154. Accordingly, inclusion of the recirculation restrictor ring 272 results in the liquid material being forced through a passage, which includes the radial bores 292 collectively, having a reduced cross-sectional area and volume as compared to an embodiment in which the restrictor ring 272 is omitted. Thereby, the recirculation backpressure is increased.

The radial bores 292 of the recirculation restrictor ring 272 may be formed with any suitable diameters, and in any suitable quantity and circumferential arrangement, chosen for providing a predetermined recirculation pressure that approximately matches a specific dispensing backpressure of the valve module 150. For example, if the dispensing nozzle 168 is substituted for another nozzle having different internal geometry, the module socket 172 may be fitted with a restrictor ring 272 having radial bores 292 formed with suitably sized diameters, and in a suitable quantity and circumferential arrangement, for approximately matching the dispensing backpressure.

Additionally, as shown in FIG. 3A, a liquid dispensing applicator may include multiple valve modules 150, each module 150 including a respective recirculation restrictor ring 272 suitably formed to approximately match a recirculation backpressure of that module 150 to its dispensing backpressure. Accordingly, even where one of more of the modules 150 on the applicator is operated at a unique liquid flow rate and/or fitted with a unique dispensing nozzle 168, the recirculation backpressure of each module 150 may be independently controlled so as to approximately neutralize a differential between the recirculation and dispensing pressures of that module 150. In this manner, the collective plurality of modules 150 on the applicator may operate concurrently with improved dispensing performance.

Figure 4A:
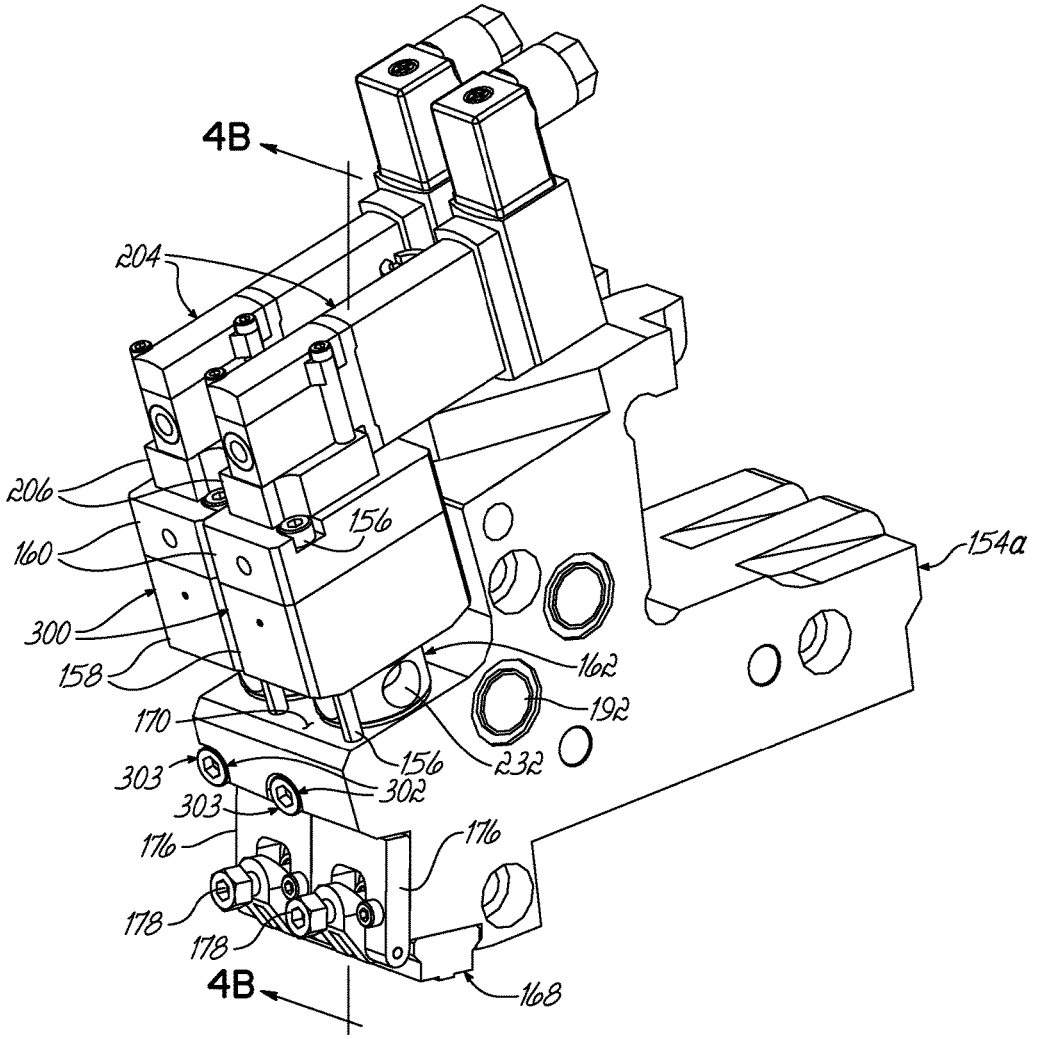
FIG. 4A is a front perspective view of an insert-style valve module coupled with an applicator manifold, in combination with an adjustable recirculation backpressure control device in accordance with a fourth embodiment of the invention.
Figure 4B:
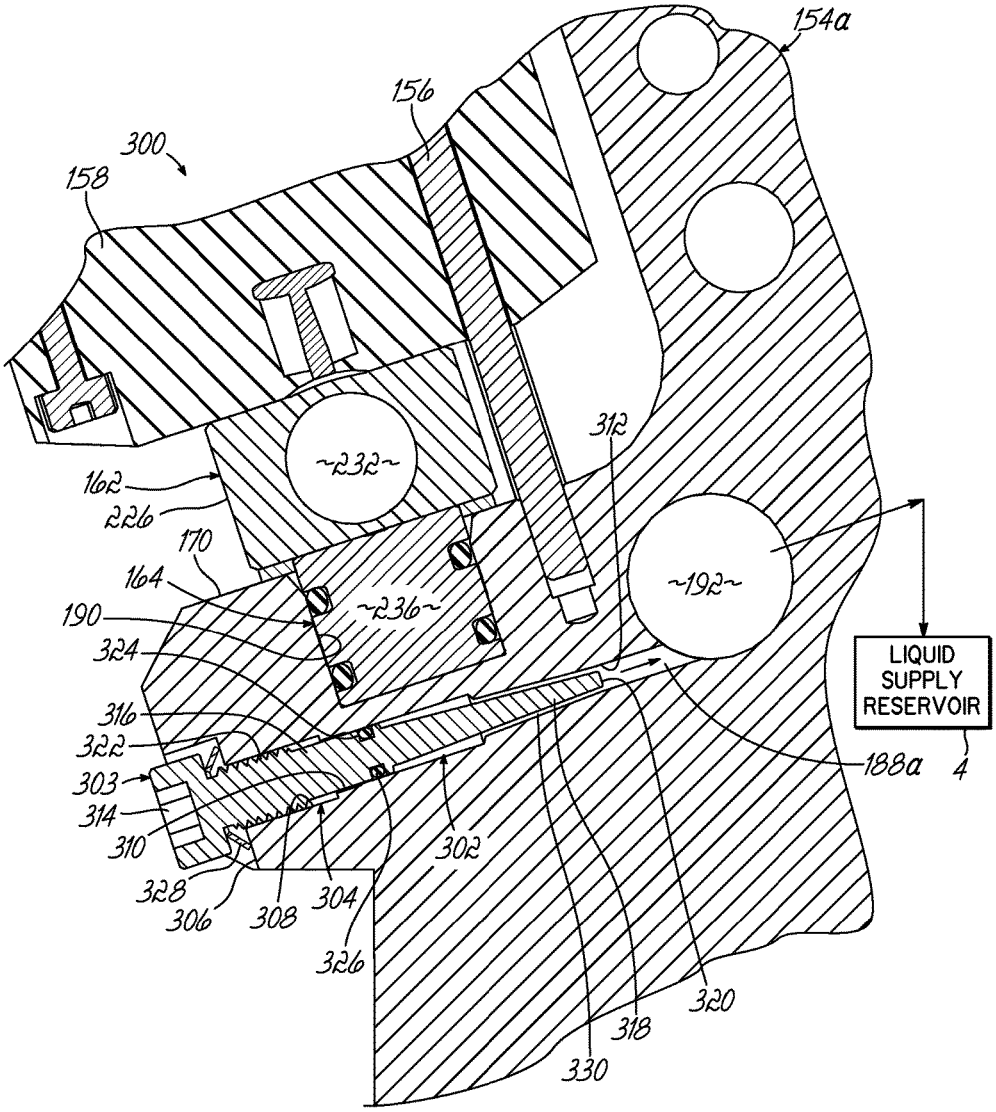
FIG. 4B is an enlarged side cross-sectional view taken along line 4B-4B of the valve module and applicator manifold of FIG. 4A, showing the valve module in the liquid recirculation mode.
Figure 4C:
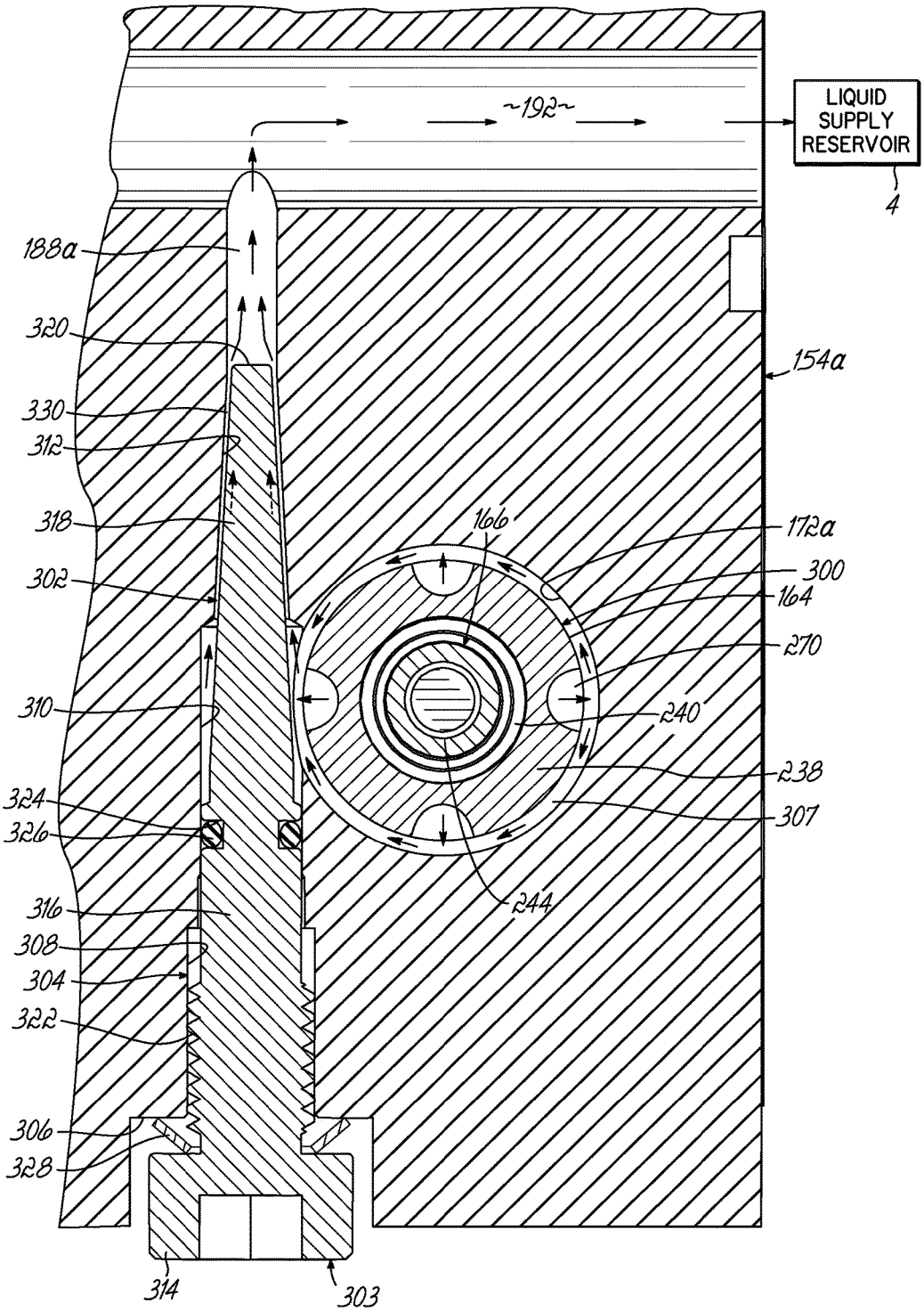
FIG. 4C is an enlarged top cross-sectional view taken along line 4C-4C of the valve module and applicator manifold of FIG. 4A, showing the valve module in the liquid recirculation mode.

Referring to FIGS. 4A-4C, a fourth embodiment of a valve module 300 and an adjustable recirculation backpressure control device 302 is shown. The module 300 is similar in construction to valve module 150 shown in FIGS. 3A and 3B, except as otherwise described below. In that regard, similar reference numerals refer to similar features shown and described in connection with FIGS. 3A and 3B.

In the embodiment of FIGS. 4A-4C, the recirculation backpressure control device 302 is in the form of an adjustable needle valve including a needle 303 and a valve port 304 in which the needle 303 is received, the valve port 304 being formed in the manifold segment 154*a*. The needle 303 and the valve port 304 are similar in construction and function to the needle 101 and valve port 102 described above in connection with the valve module 10 shown in FIG. 1D, except as otherwise noted below.

As shown best in FIGS. 4B and 4C, the valve port 304 opens to a front surface 306 on the manifold segment 154*a*, and extends inwardly toward and communicates with a recirculation outlet passage 188*a* and the recirculation channel 192. The valve port 304 also communicates with an annular liquid recirculation chamber 307 defined between an inner surface defining the module socket 172*a* and the lower casing portion 238 at a location near the angled passages 270. As shown in FIG. 4C, the annular recirculation chamber 307 communicates with the angled passages 270. Furthermore, it will be understood that the recirculation restrictor ring 272 described above is omitted from the valve module 300 of this embodiment, and that the module socket 172*a* is thus sized and shaped to receive the valve stem casing 164 alone in sealing contact.

The valve port 304 includes a threaded counterbore 308 extending through the front surface 306 of the manifold segment 154*a*, a cylindrical bore 310 extending from the counterbore 308, and a tapered bore 312 extending from the cylindrical bore 310. The cylindrical bore 310 opens laterally to the annular recirculation chamber 307, and the tapered bore 312 opens distally to the recirculation outlet passage 188*a*.

The adjustable needle 303 is received within the valve port 304 and includes a head 314, a cylindrical medial portion 316 extending from the head 314, and a tapered portion 318 extending from the cylindrical medial portion 316 and defining a needle tip 320. The cylindrical medial portion 316 includes a thread 322 that threadedly engages the threaded counterbore 308 of the valve port 304, and an annular notch 324 adapted to receive a sealing element 326 for sealingly engaging the cylindrical bore 310 of the valve port 304. The tapered portion 318 is received within the tapered bore 312 of the valve port 304 such that the needle tip 320 extends toward the recirculation outlet passage 188*a*. A shim washer 328 may be positioned between the head 314 of the needle 303 and the manifold segment 154*a*, and may be similar in construction and function to shim washer 126 described above in connection with FIG. 1D.

A tapered annular space 330 is defined between the tapered portion 318 of the needle 303 and the tapered bore 312 of the valve port 304. Accordingly, the tapered annular space 330 defines a device passage of the recirculation backpressure control device 302 through which the liquid material is directed in the liquid recirculation mode. In a manner similar to that described above in connection with FIGS. 1C and 1D, the needle 303 may be selectively rotated to advance the tapered portion 318 further into, or withdraw the tapered portion 318 away from, the tapered bore 312 of the valve port 304. Thereby, the cross-sectional area and volume of the tapered annular space 330 may be selectively decreased, or increased, and thus the recirculation backpressure may be selectively increased, or decreased to achieve a specific predetermined recirculation backpressure.

As similarly described above in connection with FIG. 1D, selective adjustment of the needle 303 within the valve port 304 enables approximate matching of the recirculation backpressure to the dispensing backpressure corresponding to the valve module 300. Thereby, a pressure differential between these two backpressures may be effectively neutralized.

Furthermore, where a dispensing applicator includes multiple valve modules 300 positioned at side-by-side module locations along the length of the applicator manifold 154*a*, an independent adjustable needle valve 302 may be provided for use with each of the modules 300 at their respective module locations. Accordingly, each module 300 may be operated at a unique liquid flow rate and/or may communicate with a dispensing nozzle 168 having unique internal geometry, such that liquid material flowing through each module 300 experiences a unique recirculation pressure and/or a unique dispensing pressure, including a unique dispensing backpressure. Advantageously, the respective needle valve 302 corresponding to each module 300 at its respective module location may be independently adjusted so as to control the recirculation backpressure for that module 300 and approximately match the recirculation backpressure to the dispensing backpressure for that module 300, thereby neutralizing a differential between the dispensing and recirculation backpressures for that module 300. In this manner, the recirculation flow path corresponding to each module 300 may be independently tuned so that the collective plurality of modules 300 may operate concurrently with improved dispensing performance.

It will be understood that an applicator according to an alternative embodiment may include one or more valve modules 150 and one or more valve modules 300. Accordingly, the applicator may include backpressure control devices in the form of one or more fixed recirculation restrictor rings 272 and one or more adjustable needle valves 302, each backpressure control device 272, 302 configured to approximately neutralize a differential between the recirculation and dispensing pressures of its respective valve module 150, 300.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. An applicator for dispensing liquid material onto a substrate, said applicator comprising:

a body including:

an inlet passage for receiving liquid material, a dispensing outlet passage for directing the liquid material toward the substrate, and a recirculation outlet passage for recirculating the liquid material;

a valve module having a dispensing mode and a recirculation mode, wherein said valve module directs the liquid material through said dispensing outlet passage in said dispensing mode and directs the liquid material through said recirculation outlet passage in said recirculation mode, said valve module including a valve stem movable between an open position in which said valve module operates in said dispensing mode and a closed position in which said valve module operates in said recirculation mode; and a backpressure control device provided in said body and configured to adjust the backpressure experienced by the liquid material, the backpressure control device having a device passage that communicates with said recirculation outlet passage, wherein said backpressure control device directs the liquid material through said device passage when said valve module is in said recirculation mode such that a backpressure experienced by the liquid material in said recirculation mode is substantially equal to a backpressure experienced by the liquid material in said dispensing mode.

2. The applicator of claim 1, wherein said backpressure control device includes a device portion that is movable relative to said body to adjust a volume of said device passage.

3. The applicator of claim 2, wherein said backpressure control device includes a valve having a needle and a port that receives said needle, said needle and said port forming said device passage therebetween; and wherein said needle includes a tapered portion, said port includes a tapered bore that receives said tapered portion, and said device passage includes a tapered annular space formed between said tapered portion of said needle and said tapered bore of said port.

4. The applicator of claim 1, wherein said backpressure control device is fixed relative to said body such that said device passage has a fixed volume.

5. The applicator of claim 4, wherein said backpressure control device includes an insert received within at least a portion of said recirculation outlet passage, said insert having a bore that forms said device passage.

6. The applicator of claim 4, wherein said backpressure control device includes a ring that encircles said valve stem, said ring having a radially outer wall, a radially inner wall, and a plurality of circumferentially spaced bores extending between said radially inner wall and said radially outer wall, and wherein said plurality of circumferentially spaced bores forms at least a portion of said device passage.

7. The applicator of claim 6, wherein said ring further includes an outer annular groove formed on said radially outer wall and an inner annular groove formed on said radially inner wall, said outer annular groove at least partially forming an outer annular chamber and said inner annular groove at least partially forming an inner annular chamber, and wherein said device passage includes said outer annular chamber and said inner annular chamber.

8. An applicator for dispensing liquid material onto a substrate, said applicator comprising:

a first valve module having a first valve stem and a second valve module having a second valve stem, each of said first and second valve modules having a dispensing mode for dispensing liquid material and a recirculation mode for recirculating liquid material;

a first backpressure control device within said first valve module that independently controls a first backpressure of the liquid material recirculated by said first valve module; and a second backpressure control device within said second valve module that independently controls a second backpressure of the liquid material recirculated by said second valve module.

9. The applicator of claim 8, wherein said first backpressure control device includes a first device passage through which the liquid material is directed when said first valve module is in said recirculation mode, said first backpressure control device further including a first device portion that is movable to adjust a volume of said first device passage; and wherein said first device portion is movable in a first direction to reduce the volume of said first device passage and thereby increase the first backpressure of the liquid material being recirculated, and said first device portion is movable in a second direction to increase the volume of said first device passage and thereby decrease the first backpressure of the liquid material being recirculated.

10. The applicator of claim 9, wherein said second backpressure control device includes a second device passage through which the liquid material is directed when said second valve module is in said recirculation mode, said second backpressure control device further including a second device portion that is movable to adjust a volume of said second device passage; and wherein said second device portion is movable in a first direction to reduce the volume of said second device passage and thereby increase the second backpressure of the liquid material being recirculated, and said second device portion is movable in a second direction to increase the volume of said second device passage and thereby decrease the second backpressure of the liquid material being recirculated.

11. The applicator of claim 8, wherein:

said first backpressure control device further includes a first device portion that is movable to independently control the first backpressure of the liquid material recirculated by said first valve module; and said second backpressure control device further includes a second device portion that is movable to independently control the second backpressure of the liquid material recirculated by said second valve module.

12. The applicator of claim 8, wherein a backpressure experienced by the liquid material in said recirculation mode is substantially equal to a backpressure experienced by the liquid material in said dispensing mode in each of said first and second valve modules.

13. A method of dispensing liquid material with an applicator including a body having an inlet passage, a recirculation outlet passage, a valve module having a valve stem movable between an open position for dispensing liquid material and a closed position for recirculating liquid material, and a backpressure control device provided in said body and having a device passage and a device portion that is movable relative to the body, the method comprising:

receiving liquid material through the inlet passage formed in the body;

directing the liquid material from the inlet passage toward the valve stem;

moving the valve stem to the closed position;

directing the liquid material through the device passage of the backpressure control device and through the recirculation outlet passage such that the liquid material experiences a backpressure; and moving the device portion to adjust a volume of said device passage to increase the backpressure or to decrease the backpressure of the liquid material.

14. The method of claim 13, wherein moving the device portion to adjust the volume of said device passage to increase the backpressure comprises moving the device portion in a first direction to decrease the volume of said device passage to increase the backpressure.

15. The method of claim 13, wherein moving the device portion to adjust the volume of said device passage to decrease the backpressure comprises moving the device portion in a second direction to increase the volume of said device passage to decrease the backpressure.

16. A method of dispensing liquid material with an applicator including a first valve module and a second valve module, the method comprising:

receiving liquid material into the first valve module and the second valve module;

opening the first and second valve modules to dispense the liquid material;

closing the first and second valve modules to stop dispensing the liquid material;

recirculating the liquid material while the first and second valve modules are closed; and independently controlling a first recirculation backpressure in the first valve module relative to a second recirculation backpressure in the second valve module while recirculating the liquid material.

17. The method of claim 16, wherein the applicator includes a recirculation backpressure control device having a device passage, and independently controlling the first recirculation backpressure includes directing the liquid material through the device passage of the recirculation backpressure control device.

18. The method of claim 17, wherein the recirculation backpressure control device includes a movable device portion, and wherein independently controlling the first recirculation backpressure includes at least one of moving the movable device portion in a first direction to increase the first recirculation backpressure or moving the movable device portion in a second direction to decrease the first recirculation backpressure.

19. The method of claim 18, wherein moving the movable device portion includes adjusting a volume of the device passage.

20. The method of claim 16, wherein the applicator includes a first recirculation backpressure control device and a second recirculation backpressure control device, and independently controlling the first recirculation backpressure relative to the second recirculation backpressure includes directing the liquid material through the first recirculation backpressure control device operating with the first valve module and through the second recirculation backpressure control device operating with the second valve module.

* * * * *